US010132452B2

(12) United States Patent
Rudisill et al.

(10) Patent No.: US 10,132,452 B2
(45) Date of Patent: Nov. 20, 2018

(54) SUSPENDED TRACK AND PLANAR ELECTRODE SYSTEMS AND METHODS

(71) Applicants: Charles Albert Rudisill, Apex, NC (US); Daniel John Whittle, Bellingham, WA (US)

(72) Inventors: Charles Albert Rudisill, Apex, NC (US); Daniel John Whittle, Bellingham, WA (US)

(73) Assignee: APEX TECHNOLOGIES, INC., Apex, NC (US)

( * ) Notice: Subject to any disclaimer, the term of this patent is extended or adjusted under 35 U.S.C. 154(b) by 177 days.

(21) Appl. No.: 15/213,115

(22) Filed: Jul. 18, 2016

(65) Prior Publication Data

US 2016/0327222 A1 Nov. 10, 2016

Related U.S. Application Data

(63) Continuation-in-part of application No. 15/010,605, filed on Jan. 29, 2016, now Pat. No. 9,583,871, which (Continued)

(51) Int. Cl.
*H01R 11/20* (2006.01)
*F21S 2/00* (2016.01)

(Continued)

(52) U.S. Cl.
CPC ..... *F21S 2/005* (2013.01); *F21V 21/008* (2013.01); *F21V 21/096* (2013.01); *F21V 21/35* (2013.01); *F21V 23/06* (2013.01); *F21Y 2115/10* (2016.08)

(58) Field of Classification Search
CPC ..... H01R 4/2404

(Continued)

(56) References Cited

U.S. PATENT DOCUMENTS 737,027 A 8/1903 Rutledge
1,067,024 A * 7/1913 Hall ..... H02G 3/00 313/51

(Continued)

FOREIGN PATENT DOCUMENTS

DE 3811740 A1 10/1989
DE 8904398 U1 9/1990

(Continued)

OTHER PUBLICATIONS

"WAC FlexrailHM1-T4_IN" (WAC Lighting Installation Instructions for Fexrail1™ System—Line Voltage) found at http://www.waclighting.com/sites/waclighting.com/files/product/instrsheet/HM1-T4_IN.pdf downloaded on May 2, 2016.

*Primary Examiner* — Neil Abrams
(74) *Attorney, Agent, or Firm* — Patent Leverage LLC

(57) ABSTRACT

Suspended and planar electrode systems and methods are disclosed for applications such as lighting. Some embodiments incorporate removable twist-on elements providing uniform spacing between cable rod or strip electrodes extending through space. Multiple electrodes may be attached simultaneously. Twist-on elements may contain light emitting elements electrically attached to parallel electrodes. Embodiments may include mounting features for fixing electrodes above a mounting surface. Some embodiments include electrically insulated electrodes and modules with insulation displacement contact elements and environmental sealing. Some embodiments include polymeric insulation on both the module and electrodes providing environmental sealing when modules are disconnected from electrodes. Electrodes in sealed systems may be suspended with spacers or built into planar arrays in walls, ceiling or furniture. Some embodiments include folded electrode gyrating tracks having mounting positions providing differ- (Continued)

(SECTION A-A OF FIG. 28)

ent axial and radial pointing directions. Modules may be attached to electrodes by mechanical or magnetic forces.

21 Claims, 25 Drawing Sheets

Related U.S. Application Data is a continuation of application No. 13/910,132, filed on Jun. 5, 2013, now Pat. No. 9,300,081.

(60) Provisional application No. 61/786,037, filed on Mar. 14, 2013, provisional application No. 61/786,037, filed on Mar. 14, 2013, provisional application No. 62/193,073, filed on Jul. 16, 2015.

(51) Int. Cl.

| | |
|---|---|
| ***F21V 23/06*** | (2006.01) |
| ***F21V 21/096*** | (2006.01) |
| ***F21V 21/35*** | (2006.01) |
| ***F21V 21/008*** | (2006.01) |
| *F21Y 115/10* | (2016.01) |

(58) Field of Classification Search
USPC ..... 439/426, 419
See application file for complete search history.

(56) References Cited

U.S. PATENT DOCUMENTS 2,139,815 A * 12/1938 Fodor ..... G09F 13/26 313/312
2,276,559 A 3/1942 Bashore
2,386,129 A 10/1945 Maack
2,396,512 A 3/1946 Johnson
2,620,029 A * 12/1952 Turechek ..... E21B 43/116 166/192
2,700,141 A * 1/1955 Jones ..... H01R 13/523 439/259
2,721,891 A 10/1955 Kersten
2,858,518 A * 10/1958 Chrystie ..... H01R 13/02 439/259
2,915,580 A 12/1959 Gill et al.
3,158,420 A * 11/1964 Olson ..... H01B 17/306 439/390
3,248,089 A 4/1966 Barney
3,344,316 A * 9/1967 Stelmak ..... H05K 3/325 174/260
3,474,381 A * 10/1969 Baldwin ..... B60Q 1/2615 362/652
3,748,463 A 7/1973 Trassinelli
3,784,959 A * 1/1974 Horton ..... H01R 13/523 439/275
3,848,949 A * 11/1974 Falkner ..... E21B 33/0385 439/259
3,853,382 A * 12/1974 Lazar ..... H01H 1/021 174/257
3,853,385 A * 12/1974 Palazzetti ..... H01R 4/2404 439/190
4,023,882 A * 5/1977 Pettersson ..... H01R 4/26 439/426
4,402,151 A * 9/1983 Medow ..... A63H 33/26 40/541
4,425,017 A 1/1984 Chan
4,578,731 A 3/1986 Andriessen et al.
4,824,390 A 4/1989 Crane et al.
4,837,667 A 6/1989 Grau
4,861,273 A 8/1989 Wenman et al.
4,999,755 A * 3/1991 Lin ..... F21S 2/00 362/217.02
5,049,081 A 9/1991 Ribitsch et al.
5,153,988 A 10/1992 Mattis et al.
5,158,360 A * 10/1992 Banke ..... F21S 8/068 362/391
5,273,449 A 12/1993 Mattis et al.
5,310,355 A * 5/1994 Dannatt ..... F21V 19/0005 362/249.01
5,340,322 A 8/1994 Poulsen
5,348,485 A * 9/1994 Briechle ..... H01R 25/14 439/110
5,351,620 A 10/1994 Becheau et al.
5,428,298 A * 6/1995 Ko ..... G01R 1/06738 324/750.05
5,584,576 A * 12/1996 Wei Hong ..... F21V 21/26 362/147
5,797,759 A 8/1998 Mattis et al.
5,924,888 A 7/1999 Larkin
5,967,823 A * 10/1999 Tsui ..... F21S 4/10 439/280
6,132,859 A 10/2000 Jolly
6,170,967 B1 * 1/2001 Usher ..... F21V 23/06 200/227
6,176,739 B1 1/2001 Denlinger et al.
6,394,626 B1 5/2002 McColloch
6,540,372 B2 4/2003 Joseph
7,092,257 B2 8/2006 Westerheide
7,137,727 B2 11/2006 Joseph et al.
7,156,689 B2 1/2007 Fabian et al.
7,364,433 B2 4/2008 Neidlein
7,585,175 B2 9/2009 Sinclair et al.
7,661,229 B2 2/2010 Freeska et al.
7,665,883 B2 2/2010 Matheson
7,677,914 B2 3/2010 Nall et al.
7,687,288 B2 3/2010 Saha et al.
7,692,100 B2 4/2010 Boisclair
7,726,974 B2 6/2010 Shah et al.
7,762,821 B2 7/2010 Patterson et al.
7,803,004 B2 9/2010 Remes et al.
7,806,569 B2 10/2010 Sanroma et al.
7,928,602 B2 4/2011 Heidmann
8,128,427 B2 * 3/2012 Mochizuki ..... F21S 48/212 439/419
8,187,006 B2 5/2012 Rudisill et al.
9,039,230 B2 5/2015 Crimi et al.
9,413,102 B1 * 8/2016 Wright ..... H01R 13/527
9,484,643 B2 * 11/2016 Schaefer ..... H01R 4/242
9,583,871 B1 * 2/2017 Rudisill ..... H01R 13/6205
2003/0031018 A1 2/2003 Bray et al.
2005/0157506 A1 7/2005 Chen
2008/0139054 A1 * 6/2008 Williamson ..... H01R 35/04 439/801
2008/0173462 A1 7/2008 Whapham et al.
2008/0175011 A1 7/2008 Joseph
2009/0201680 A1 8/2009 Chang et al.
2010/0164409 A1 7/2010 Lo et al.
2010/0320896 A1 12/2010 Pet et al.
2010/0327744 A1 12/2010 Willemsen et al.
2011/0140136 A1 6/2011 Daily et al.
2011/0308562 A1 12/2011 Shufflebotham
2012/0045918 A1 2/2012 Litzler et al.
2012/0075857 A1 3/2012 Verbrugh
2012/0261164 A1 10/2012 McKinnon
2012/0300437 A1 11/2012 Lu et al.
2013/0044485 A1 2/2013 Zaderej et al.
2013/0044501 A1 2/2013 Rudisill et al.
2013/0294081 A1 11/2013 O'Connor et al.
2013/0308324 A1 11/2013 Zaderej et al.
2014/0268835 A1 9/2014 Rudisill et al.
2014/0293544 A1 10/2014 Zaderej et al.

FOREIGN PATENT DOCUMENTS

DE 19726930 C1 9/1998
DE 10355232 A1 6/2005
EP 0404979 B1 9/1996
EP 0734108 A2 9/1996
EP 1167867 A2 2/2002
EP 1733653 A2 12/2006
EP 2077416 A2 7/2009

(56) References Cited

FOREIGN PATENT DOCUMENTS

| | | | |
|---|---|---|---|
| FR | 2613883 | A1 | 10/1988 |
| GB | 2401672 | A | 11/2004 |
| JP | 2004533328 | A | 9/2004 |

* cited by examiner (SECTION B-B)

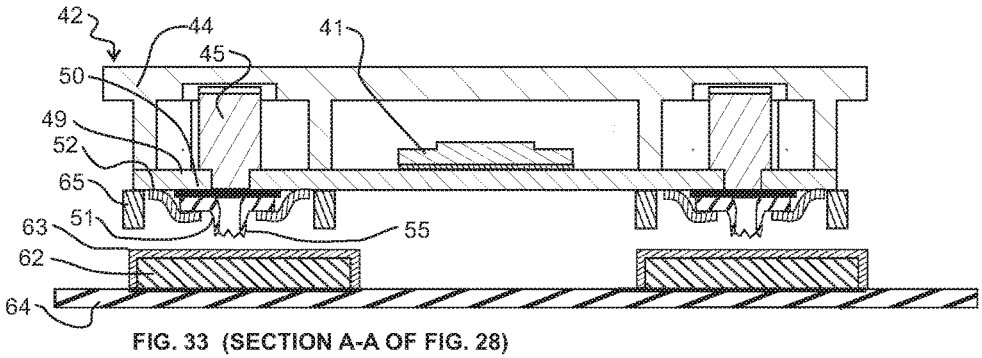
FIG. 33 (SECTION A-A OF FIG. 28)
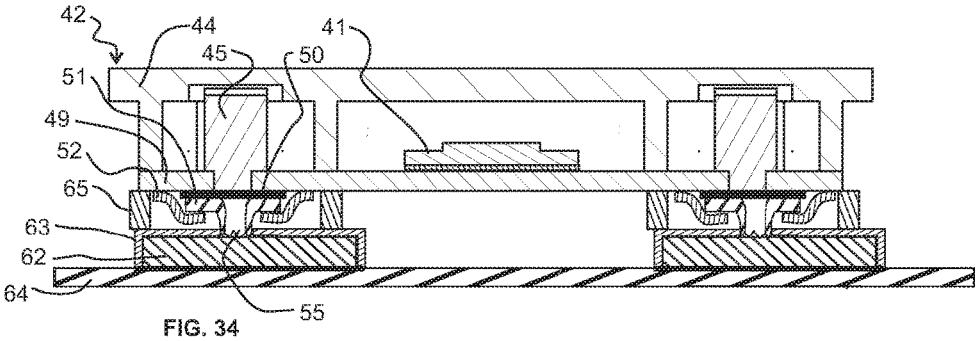
FIG. 34
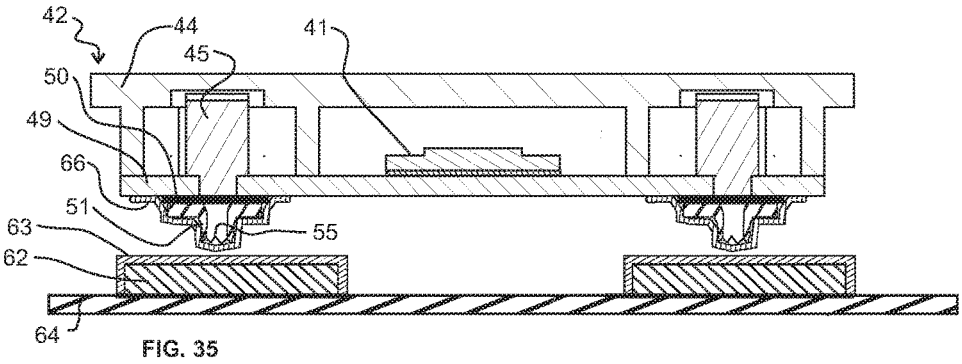
FIG. 35
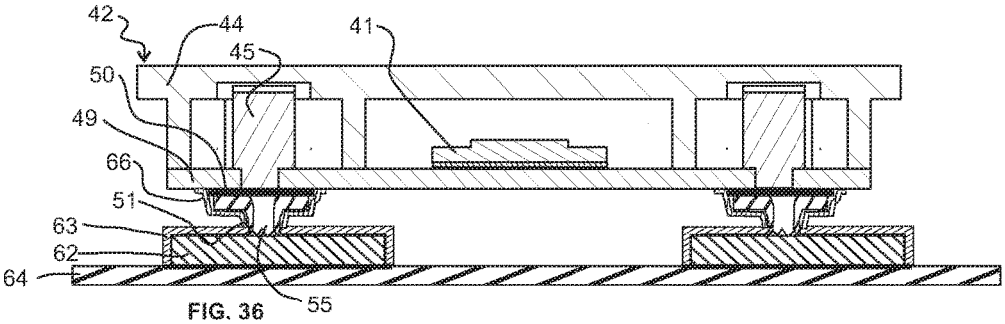
FIG. 36

(SECTION A-A
OF FIG. 40)

(DETAIL 'A'
OF FIG. 42)

(DETAIL 'B'
OF FIG. 43)

(VIEW Z OF FIG. 52)

(SECTION B-B
OF FIG 71)

SUSPENDED TRACK AND PLANAR ELECTRODE SYSTEMS AND METHODS

BACKGROUND OF THE INVENTION

Cable lighting systems are known in which lighting fixtures are attached between flexible parallel electrodes that are maintained straight through tension. Some systems are difficult to install and require turnbuckles and other relatively expensive elements and tools to make mechanical and electrical attachments. Positioning and routing of the electrodes through a space or along a surface in anything but a straight path can be difficult or require special elements to change electrode direction.

Spacers to maintain uniform spacing between cable or rod electrodes that require installation from only ends of the electrodes are inconvenient to assemble onto long lengths of electrode. Pre-attached spacers may prevent insertion of the electrodes through an opening that is smaller than the electrode spacing.

Interference-fit spacers that snap onto cylindrical electrodes through relative movement along one direction are often difficult to install. The relatively small electrode diameters may also make mechanical tolerances requirements difficult to achieve for a reliable interference fit of an electrode forced into a conventional snap-fit slot feature. The forces required to overcome the snap constriction may lead to permanent deformation of the electrodes especially in installation environments that have limited clearance for snapping the electrodes into a spacer.

Track lighting systems employing some form of parallel electrodes mounted to a substrate are known. While flexible track systems are known that can bend to some extent in a direction perpendicular to the track substrate, changing direction in the plane of the electrodes (that is, along the mounting surface) may require special turning elements that restrict three-dimensional paths, make installation difficult and/or increase costs. Once installed, changing the pointing direction of light fixtures to new direction typically requires modifying the path of the track or providing lighting pucks that have mechanical elements for redirecting the emission by tilting the fixture and/or rotating the fixture or an optical element of the fixture. This pointing flexibility generally increases system size, weight, and the number of parts of the fixture which usually increases system costs and may negatively impact industrial design options.

While these cable and track lighting systems provide more flexibility than stationary lighting fixtures, they do not meet all of the needs for easily initially configuring and subsequently changing lighting in a space. Accordingly, it is desirable to provide an alternate system that provides fixture mounting at different positions with different orientations along the length of a substantially linear track electrode system or at different locations on the surface of a planar electrode system for lighting or other electronic modules with greater system installation flexibility, reliability and environmental stability or that provides one or more other advantages over existing cable, track and planar systems.

BRIEF SUMMARY OF THE INVENTION

The disclosed systems and methods address at least one or more of the issues in the prior art. Apparatus, systems and methods disclosed herein include those which relate to holding relatively long electrodes at a fixed spacing along a path. In one embodiment the mounting includes insulated spacer means for maintaining a uniform distance between free-standing cable or rod electrodes without making electrical contact to the electrodes. The electrodes may be held in place through rotation of at least a portion of the spacer. In an embodiment, the mounting may include means for making electrical connections to two electrodes to power a light emitting element on a fixture incorporating the rotating mount. In an embodiment, the electrodes are fixed to the element by inserting flexible or rigid electrodes into radial slots at or near the ends of the element and then rotating the element about an axis located between the electrodes to simultaneously fix the element to the electrodes. In an embodiment, electrodes are inserted into tangential slots of an element prior to being guided to a parallel configuration through one or more rotations of the spacer or fixture.

Embodiments disclosed include engagement slots that do not require the sequential threading of the elements from either end of the electrodes. That is, elements can be added or removed at positions located between other elements without removal of any adjacent elements.

Lighting fixtures for use with the spacer means to create parallel electrodes may include the magnetic fixtures described in co-owned U.S. Pat. No. 8,651,711 and continuation U.S. patent application U.S. Ser. No. 14/177,227 which are hereby incorporated by reference in their entirety herein. The spacers provide a means to create a lighting track from flexible or rigid ferromagnetic cables, rods or strips with a uniform distance appropriate for modular lighting pucks with magnetic attachment.

These spacers are not restricted to use with magnetically-attached lighting modules, but may be used to form a parallel electrode system for other types of cable lighting fixtures. An embodiment includes uniform spacing between electrodes only where elements are to be attached; at other positions, the electrodes may have non-uniform spacing to change direction or pass through a restricted orifice or around obstacles. Spacer embodiments may be used to maintain electrode spacing for magnetic fixtures having insulation displacement contacts, or "IDC", systems for piercing the insulated electrodes at the position of fixture connection. The insulation displacement contacts in some embodiments displace insulation on both the module and the electrode when connected and comprise structures and methods for environmental sealing. For the purposes of this specification, "environmental sealing" means an increase in the resistance to penetration of moisture, dust or other solid, liquid or gaseous contaminants through the seal. The level of environmental sealing necessary for different application environments is generally prescribed by specific commercial requirements and standard environmental test protocols. Mechanical and magnetic forces may be used to maintain intimate contact of the contact and electrode for electrical continuity and to provide the force for effecting the level of environmental sealing required through embodiments disclosed below.

Twist-on lighting fixture embodiments may be attached to pairs of suspended uninsulated electrodes or insulated electrodes using embodiments described below. An electrical connection is made to each of the two electrodes to a circuit including a light emitter. Twist-on fixture embodiments may include insulation displacement contact systems for piercing insulated electrodes.

Disclosed embodiments include strip electrodes that are alternately folded through positive and negative angles to that provide different pointing directions for lighting modules at different locations along the length of the track axis.

For purposes of this disclosure, a "twist-on" element is an element that uses rotation about any axis in order to make a mechanical engagement with at least one electrode. The mechanical engagement may include an interference fit which restricts relative movement or a loose coupling that allows relative movement in at least one direction after coupling. It has been found that loose coupling to electrodes with twist-on elements can be particularly advantageous when the parallel electrodes are not maintained as linear segments before or after attachment. Loose and/or tight coupling may be incorporated in the various embodiments by reducing clearance dimensions between slot features and electrode outer diameters or incorporating protrusions or channels that cause electrodes to deviate from straight paths through the element after twisting.

For the purposes of this disclosure, "suspended parallel electrodes" should be interpreted as pairs of electrodes that are not continuously supported and that maintain an approximately equal separation distance over at least some local portion. That is, they have a portion that is suspended in space over a distance on the order of the size of the attached module and are approximately parallel over this portion. The free-space clearance to a supporting structure may be as small as the minimum necessary to employ the twist-on embodiments disclosed. The term "parallel" does not require the elements to be linear over this portion; concentric arcs laying in a common plane would be locally parallel since the perpendicular distance between them would be the same over the arc segment.

Electrode embodiments are described as "cables" or "rods" or "wires" or "rails" or "strips". For the purposes of this disclosure, in most cases these terms are used interchangeably; exceptions that depend upon electrode cross-section or flexibility can be determined from context. The fundamental characteristic of all of these is that they are locally linear; that is, they have one dimension that is significantly longer compared to the other two dimensions. That is, a locally linear rail does not have to be straight. This long or "longitudinal" dimension defines the primary axis of the electrode, but the cross-section of electrodes (taken perpendicular to the longitudinal axis) is not required to have an axially symmetric shape or any mirror symmetry about the electrode axis unless specifically restricted in the detailed description. Cables, rods and wires generally have comparable dimensions in a cross-section perpendicular to their axis, while strips have more pronounced cross-sectional differences. If not specified, the term "axis" means longitudinal axis. For "strip" electrodes, the second largest dimension, i.e., the width, will for the purposes of this disclosure determine the "surface" or "face" of the strip to which electrical attachment is made; the smallest dimension, or thickness, will determine the edge of the strip. The electrode cross-section may vary along the axis. While cables may be composed of individual wire strands that provide mechanical flexibility, cables can also be solid structures that are relatively stiff. Although electrodes conduct electricity through at least a portion of the axial cross-section, the twist-on spacer elements may also have use in non-electrical applications. Mechanical applications are considered to be within the scope of this disclosure.

Embodiments of electrode systems are disclosed that are suspended in space or built on the surface of a planar surface as linear tracks or incorporated into a portion of a wall, ceiling or other surface element. The term "planar array" of electrodes for the purposes of this disclosure refers to two or more electrodes that are mounted to a planar surface. Planar arrays are not required to consist of parallel electrodes. The electrode systems may be covered by an insulating layer or coating for environmental protection and/or to prevent inadvertent touching of an energized electrode. The electrodes are combined with modules to create a system in which electrical and mechanical contact between the electrodes and the module is used to transfer electrical power and/or data between the electrode and the module. Typically, the module will receive electrical power or data from the electrodes, but for the purposes of this disclosure, the module may provide electrical power or data to the electrodes. Lighting modules are specifically discussed as a non-limiting example in the embodiments below, but non-lighting modules such as sensors, cameras, power sources or convertors, cable or other connectors or other passive or active electrical systems are also considered within the scope of this disclosure. The terms "module", "puck" and "fixture" are used interchangeably to denote any of the electrical elements that are connected to electrodes through the elements and methods described.

Some embodiments describe methods in which electrodes are approximately located parallel to one another and then twist-on elements are presented to the electrodes for attachment. Other embodiments describe positioning twist-on elements along a surface to define a path for the electrodes that are subsequently presented to the twist-on elements for attachment. For purposes of this disclosure, a description of an embodiment in which the wires are positioned first should be understood to also disclose an embodiment in which the twist-on elements are positioned first as well as an embodiment where some twist-on elements are positioned first to which wires are presented and attached, followed by additional twist-on elements being presented to the wires and attached. Providing appropriate clearances to avoid interference in order to introduce the twist-on elements to rigid parallel electrodes is a straightforward design choice.

Some embodiments employ insulation displacement contact or "IDC" systems. Generally, these systems have one or more sharp structures that penetrate electrical insulation to make an electrical contact by slicing through the insulation. Many IDC contacts in industry use are in the form of tapered slots with opposing blade edges that cut through electrical insulation on opposite edges of round wires. This type of structure may be used to cut through insulation on insulated round wires and could be incorporated into some of the twist on elements disclosed for use with round cable lighting systems. These known IDC techniques for round wires in which a spring force also maintains the connection may be used in the twist-on lighting fixture embodiments described for insulated cables, wires or rods with cylindrical conductors.

This specification includes embodiments where IDC structures are used to make electrical connection and provide environmental sealing to a surface of a strip electrode. These IDC connections include sharp structures in the form of one or more "spikes" that are pressed through insulation to make contact to flat surfaces. For the purposes of this disclosure, a "spike" is defined as an electrically conductive pointed structure that projects locally from a supporting surface. Spikes are capable of piercing electrically insulating materials to establish electrical continuity at with an electrode surface when a force is applied substantially perpendicular to the electrode surface. A spike may have multiple sharp projections at its point.

Other terms in the specification and claims of this application should be interpreted using generally accepted, common meanings qualified by any contextual language where they are used.

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically. The terms "about" and "essentially" mean±10 percent.

Reference throughout this document to "one embodiment", "certain embodiments", and "an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

The term "or" as used herein is to be interpreted as an inclusive or meaning any one or any combination. Therefore, "A, B or C" means any of the following: "A; B; C; A and B; A and C; B and C; A, B and C". An exception to this definition will occur only when a combination of elements, functions, steps or acts are in some way inherently mutually exclusive.

The drawings featured in the figures are for the purpose of illustrating certain convenient embodiments of the present invention, and are not to be considered as limitation thereto. Term "means" preceding a present participle of an operation indicates a desired function for which there is one or more embodiments, i.e., one or more methods, devices, or apparatuses for achieving the desired function and that one skilled in the art could select from these or their equivalent in view of the disclosure herein and use of the term "means" is not intended to be limiting.

Other objects, features, embodiments and/or advantages of the invention will be apparent from the following specification taken in conjunction with the following drawings.

BRIEF DESCRIPTION OF THE DRAWINGS

FIG. 33 is a cross-sectional, unmated, view of an IDC magnetic lighting puck and electrode with compressible gasket sealing FIG. 34 is a cross-sectional, mated, view of an IDC magnetic lighting puck and electrode with compressible gasket sealing of FIG. 33.

FIG. 35 is a cross-sectional, unmated, view of an IDC magnetic lighting puck and electrode, with puck IDC contacts sealed with insulating layers.

FIG. 36 is a cross-sectional, mated, view of FIG. 35, of an IDC magnetic lighting puck and electrode, with puck IDC contacts sealed with insulating layers.

DETAILED DESCRIPTION OF THE INVENTION

Figure 1:
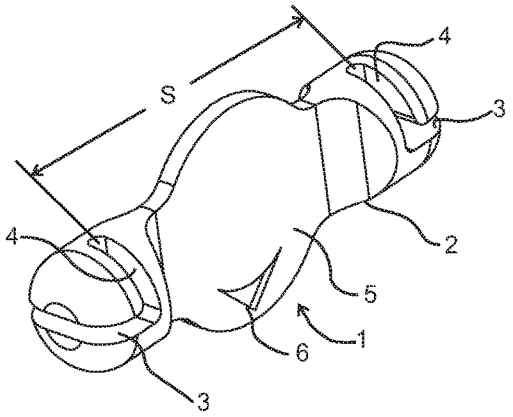
FIG. 1 is a side isometric view of a quarter-turn locking electrode spacer.
Figure 2:
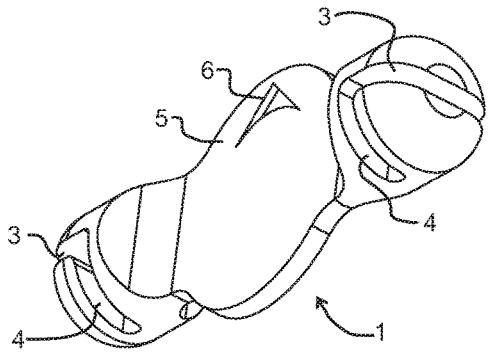
FIG. 2 is another side isometric view of a quarter-turn electrode spacer of FIG. 1.

Referring to FIG. 1 through FIG. 4 illustrating a first embodiment, the electrode track system is comprised of a twist-lock electrode spacer 1 and two electrode rails 7. The twist-lock electrode spacer 1 is comprised of an electrically insulating body 2 (or a body coated with an insulating layer) and may be made from materials such as injection-molded engineering thermoplastics (polycarbonate, ABS, polystyrene, etc.). Spacer 1 contains radial wire insertion slots 3 on each end of spacer 1, and circumferential arc electrode locking slots 4 that intersect with insertion slots 3. Electrode locking slots 4 in this embodiment are configured to extend approximately 90 degrees around the axis of the spacer. As an example, spacer 1 may be configured with circumferential locking slots 4 located approximately 1.5 inches apart (distance CS' in FIG. 1), and the width of the slots approximately 0.08" wide to accommodate a 0.08" diameter electrode material, with a general outside diameter of 0.38" and an insertion slot depth of approximately 0.25".

The electrode rails 7 may be rigid materials, semi-rigid materials (such as unhardened single-strand wire) or flexible materials such as braided cables. Semi-rigid electrode materials allow complex compound 3-dimensional freestanding electrode rail systems to be easily constructed. As illustrated, the electrode has a circular cross-section, but other electrode shapes could be used in embodiments. For magnetic attachment embodiments, electrodes may comprise materials that are attracted to magnets, such as iron or steel.

Low-voltage applications (less than about 40 volts in some countries) may not require electrical insulation of the electrodes to meet safety standards. High-, or line-, voltage applications may utilize insulated electrode materials. Insulated electrodes may also be useful in some application environments with low voltages. Lighting or other electrical fixtures used with insulated electrodes may use insulation displacement connector contacts for electrical and/or mechanical connection to the rails. In general, the twist-lock electrode spacers may be used with insulated or uninsulated electrodes.

Figure 3:
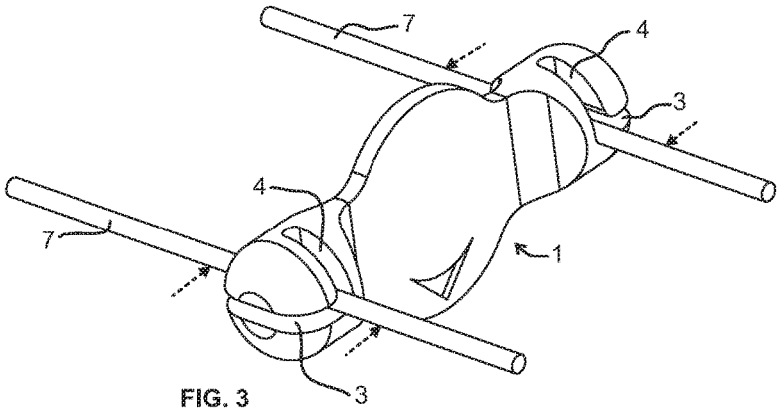
FIG. 3 is an isometric view of a quarter-turn spacer of FIG. 1 and FIG. 2 with electrode wires inserted into horizontal slots.
Figure 4:
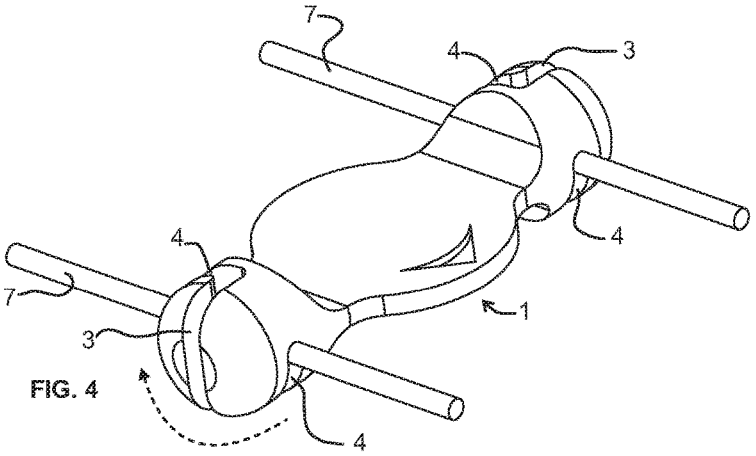
FIG. 4 is an isometric view of the quarter-turn spacer of FIG. 3 with the spacer rotated 90 degrees to lock electrodes in place.

A two-step process to assemble spacer 1 onto two electrode rails is shown schematically in FIG. 3 and FIG. 4. In the first step, the electrode rails 7 are inserted into slots 3 on both ends of the spacer as indicated by the arrows in FIG. 3 until they are positioned adjacent to locking slots 4. The second step represents the change in moving from FIG. 3 to the locked configuration of FIG. 4 and is accomplished by rotating the spacer 1 about its long axis as indicated by the curved arrow. This rotation of the electrodes within locking slots 4 attaches the spacer 1 to both of the electrode rails 7 simultaneously. As illustrated, the electrodes are locked into position with a quarter-turn twisting action.

The amount of rotational engagement is a design choice that may influence spacer mechanical strength and locking security. A locking slot designed for 90-degree rotation as shown provides a convenient "quarter-turn" locking action. The presentation slot 3 intersects with locking slot 4 at a 90-degree angle which provides a discontinuity in the electrode insertion and locking movement directions of the spacer relative to the electrodes. Acute or obtuse slot intersection angles may be used to decrease or increase the difference in relative motion from the right angle illustration above.

Additional electrode locking, detent and/or interference features may be included in the design of the spacer slots. Although the spacers will generally be removable by reversing the steps in the attachment process, some applications may benefit from more permanent attachment through the use of adhesives, heat-staking or single-use mechanical locks that cannot be loosened without damage such as ratcheting mechanisms like those used in cable zip ties. The embodiment of spacer 1 shown in FIGS. 1-7 includes an optional ergonomic flat enlarged center pad 5 that aids in installation and provides additional torque for 90-degree rotation without tools. A locking direction icon 6 may also be included.

The method of moving the electrodes relative to the spacer in preparation for the axial twist step is also a design choice. The discussion above is based upon the individual electrodes being initially movable toward one another to be positioned for the twisting lock step. In cases where the electrode rails are more rigidly fixed in relative position, the shape and position of slot 3 may be modified to present the electrodes to the ends of locking slots 4. For example, extending slots 3 toward the middle of the spacer of FIG. 3 will allow the spacer to be positioned at a skewed angle relative to and between rigidly fixed electrodes. Rotating the spacer about an axis perpendicular to the plane of the electrodes until the electrodes are positioned relative to slots 4 as shown in FIG. 3 will not require movement of the electrodes relative to one another. Tapers and/or bevels on the horizontal slots also facilitate installation of spaces between electrodes with a fixed spacing. The locking step in going from FIG. 3 to FIG. 4 will be the same as before.

Figure 5:
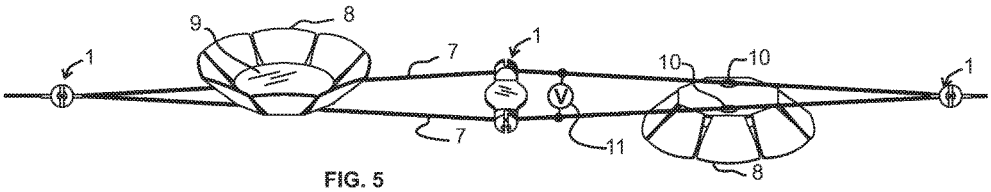
FIG. 5 is an isometric view of an electrode track with quarter-turn spacers with lighting modules attached, and electrode track twisted to orient lighting modules.
Figure 6:
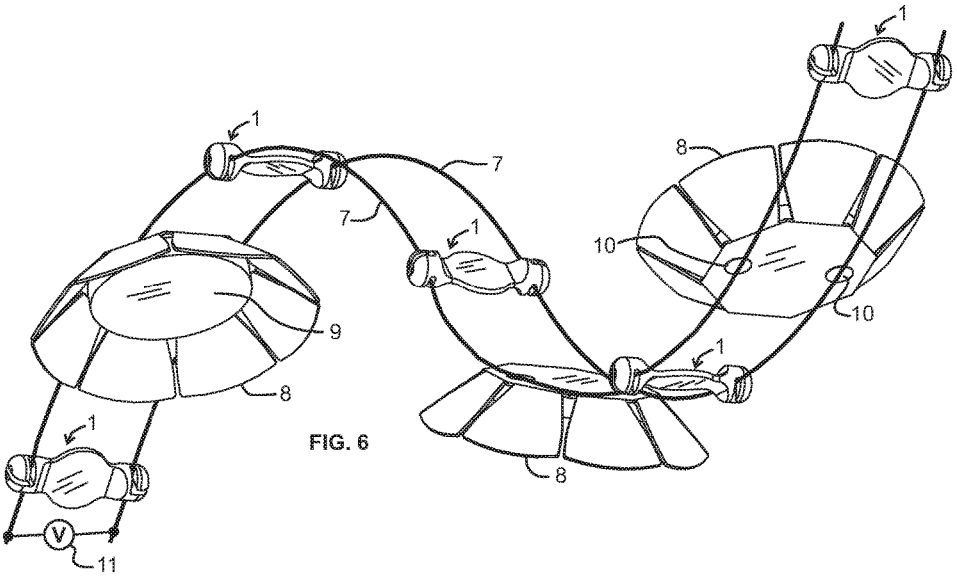
FIG. 6 is another isometric view of an electrode track with quarter-turn spacers formed in a three-dimensional curve with lighting modules attached.

A semi-rigid (i.e., deformable into a stationary shape) electrode wire and spacer system may be free-standing and may be twisted along a long axis located between the electrodes as shown in FIG. 5. FIGS. 5 and 6 include magnetically attached modular lighting fixtures 8 that are mechanically and electrically attached to the two electrodes 7 with magnetic contacts 10. Electrical power supply 11 provides electrical power through the electrodes to the lighting fixture. In this magnetic attachment case, the electrodes may comprise a steel wire that is optionally coated or clad with copper, nickel, tin or other electrically conducting material. Different forms of magnetic lighting pucks are described in co-owned U.S. Pat. No. 8,651,711. Modular lighting fixtures may be attached by mechanical and electrical attachment means that do not employ magnets. The ability to twist, bend, spiral and form the electrode track system also allows directing the light output of attached fixtures 8 from the light emitting area 9 as desired. FIG. 6 illustrates a three-dimensionally formed, semi-rigid self-supporting electrode track system comprised of two electrode rails 7, lighting fixtures 8 and spacers 1. The number of spacers and their relative positions along the axis can be chosen to provide desired stiffness and/or to maintain electrode separation distances within the attachment tolerance of the magnetic pucks. It has been found that allowing some slip capability of the spacer along the electrodes during assembly is beneficial when forming assembled electrode systems into arbitrary shapes. After the final desired shape is obtained, any excess electrode length can be cut off. It may be desirable to prevent slip of the electrodes at the spacers at one or both ends of the final assembly of multiple spacers to a pair of electrodes. The spacers on either end of the assembly may be fixed to the prepared electrodes with adhesives or through the use of mechanical clamping features in the spacers or in accessories such as mounting brackets, electrical power terminals, located outward of the spacer locking slots.

Figure 7:
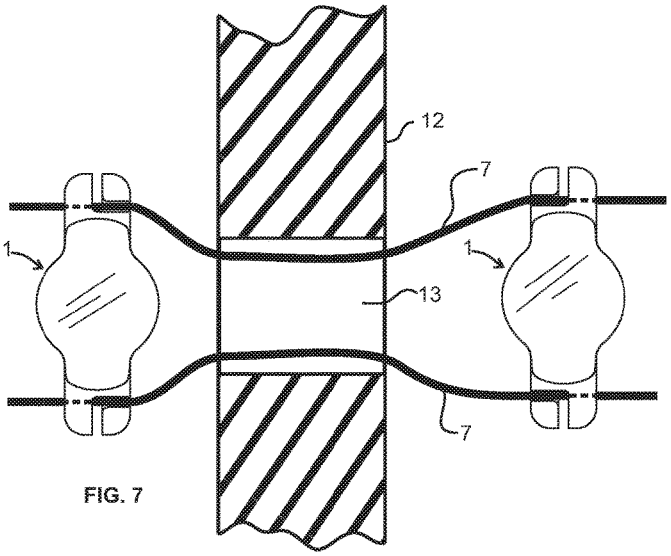
FIG. 7 is a cross-sectional view showing an electrode track assembled through an opening nominally smaller than the track width and height.
Figure 8:
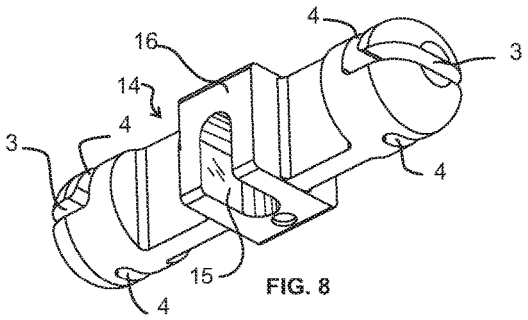
FIG. 8 is an isometric view of a quarter-turn electrode spacer having features for attachment to surfaces with a central fastener.
Figure 9:
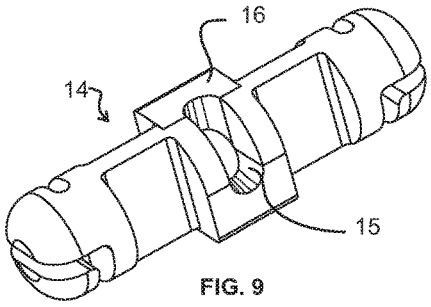
FIG. 9 is a different isometric view of FIG. 8.

Since the spacers may be easily installed at any location along electrodes and may be removably attached to the electrodes, flexibility in installation and modification is provided for different application environments. For example, when utilizing a flexible or semi-rigid electrode material (such as annealed wire), long lengths of wire may be routed in a 3-dimensional space around or through obstructions using spacers 1 applied at any desired location. FIG. 7 illustrates the ability to install electrodes through an opening that is smaller than the electrode spacing or spacer length. This would generally not be possible with conventional track light systems or with permanently attached spacers or spacers that are pre-threaded onto electrodes without removing multiple pre-threaded spacers. In this manner, relatively long lengths of electrode material 7 may be installed through multiple openings 13 followed by the installation of spacers 1 where desired afterwards. If the spacers include mounting means for attachment to a supporting element, for example, to a surface as described below, the order of installation may be reversed in whole or part.

FIG. 8 through FIG. 12 illustrate a single-piece spacer 14 that includes a channel 15 sized to accommodate a mounting fastener 17 such as a screw to hold the spacer onto a surface 18. In this embodiment, the spacer 14 may initially be loosely affixed onto mounting surface 18 with fastener 17 such that the spacer 14 is in position with insertion slots 4 substantially parallel to surface 18. This orientation allows the installation and locking of electrodes 17 similar to the electrode insertion and spacer 90-degree rotation locking method described earlier. The screw 17 may be subsequently tightened to prevent reverse rotation of the spacer in order to securely fix the electrodes to the spacer.

Figure 10:
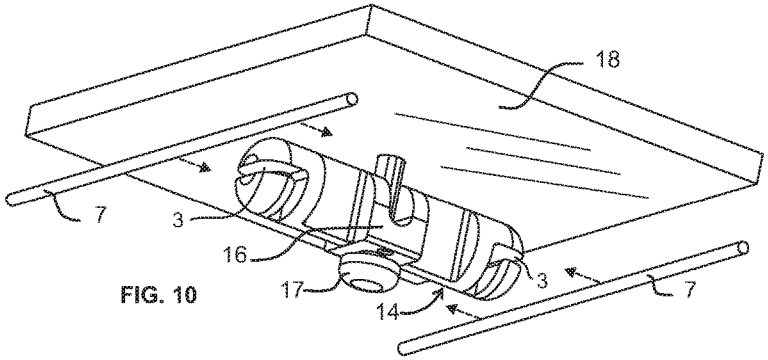
FIG. 10 is an isometric view of a quarter-turn spacer pre-attached to a surface, prior to assembling electrodes.
Figure 11:
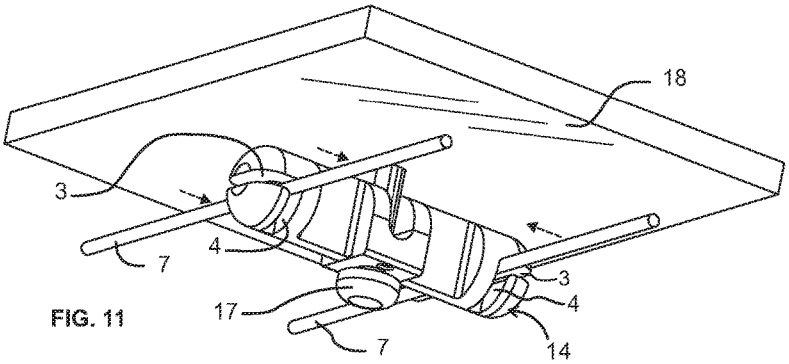
FIG. 11 is an isometric view of FIG. 10 with electrodes installed in horizontal slots of spacer.
Figure 12:
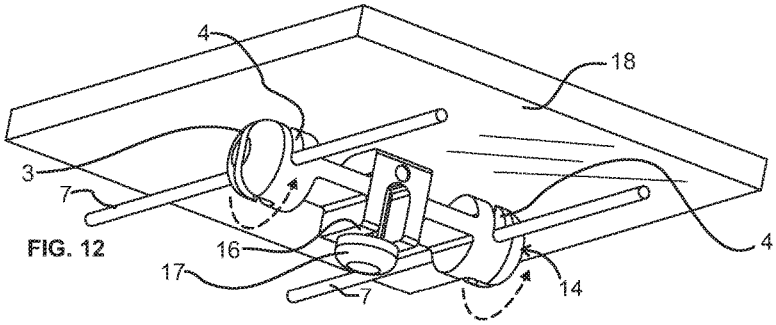
FIG. 12 is an isometric view of FIG. 11 with the spacer rotated 90 degrees to lock electrodes.

These installation steps for a single spacer are shown in FIG. 10 through FIG. 12. In FIG. 10, spacer 14 is loosely attached to with fastener 17 to surface 18, with insertion slots 3 oriented parallel to surface 18. Electrode rails 7 are then inserted into insertion slots 3 (FIG. 11), and in FIG. 12, spacer 14 is rotated 90 degrees to lock electrodes 7, and fastener 17 may be tightened for a secure fit against flat surface 16. Mechanical interference between the flat surface 16 of the spacer 14 and the head of the fastener 17 prevents reverse rotation of the spacer to separate the electrodes 7 from the spacer. As before, the amount of rotation to lock the electrodes is a design choice. In a similar manner to the arbitrary path of the electrode system shown in FIG. 6, the path of the spaced electrode pair suspended adjacent to the surface may include turns and curves between spacers. Since the path length of the electrode on the outside of a curve in the plane of the electrodes will need to be longer than that of the electrode on the inside of the curve, it is generally desirable to lock the electrodes onto the spacers 14 in sequence starting at one end of the array. Having electrodes of a relatively inexpensive wire/cable reduces the burden of estimating the path lengths of each electrode in a complex path. Cables can be cut to length after routing and locking in the spacer array.

Figure 13:
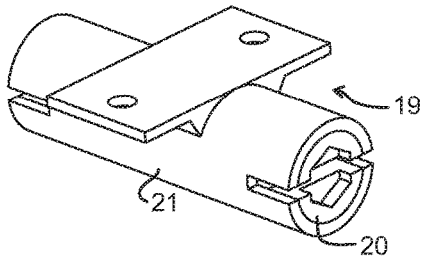
FIG. 13 is an isometric view of a two-piece quarter-turn spacer design with mounting flange.
Figure 14:
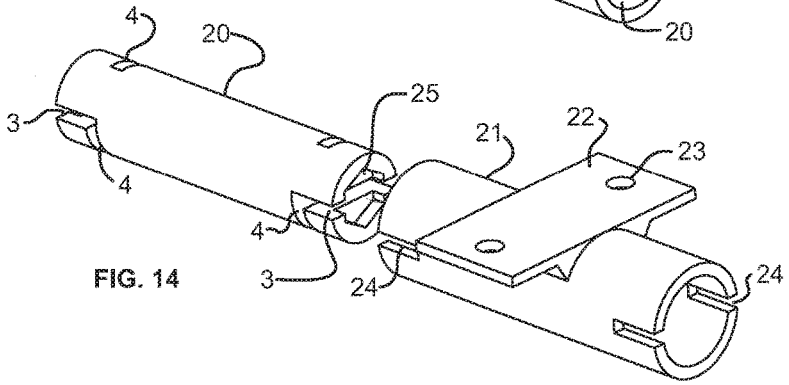
FIG. 14 is an exploded isometric view of the spacer of FIG. 13.
Figure 15:
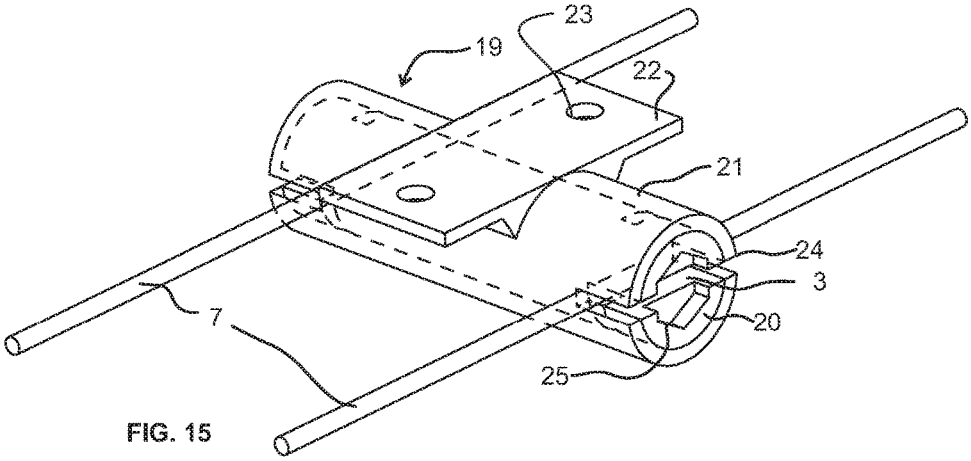
FIG. 15 is an isometric view of the two-piece spacer of FIG. 13 and FIG. 14 with electrodes installed in horizontal slots.
Figure 16:
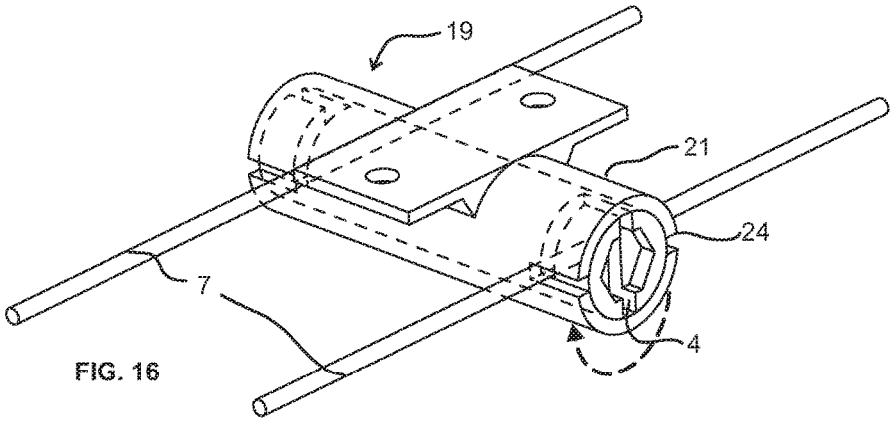
FIG. 16 is an isometric view of FIG. 15 with internal locking feature rotated to lock electrodes.

FIG. 13 through FIG. 16 illustrate an alternate two-piece surface mounting spacer assembly 19. FIG. 13 is an assembled isometric view of two-piece spacer 19, FIG. 14 is an exploded isometric view of spacer 19. Two-piece spacer 19 includes an inner electrode locking body 20, containing radial insertion slots 3 and 90 degree locking slots 4. Inner electrode locking body 20 is inserted into an outer housing body 21 and may be rotated within outer body 21 to lock the electrodes. End slots 24 allow insertion of the electrodes into the spacer assembly prior to locking. These slots 24 would typically be aligned parallel to the mounting surface of the flange 22, but may be oriented at a relatively small angle to provide an interference biasing force to reduce longitudinal electrode slippage. FIG. 15 is an isometric view of spacer 21 with two electrodes positioned in the end insertion slots 3 in the inner electrode locking body and slots 24 in the outer housing body 21. FIG. 16 is an isometric view of spacer 19 with the inner locking body 20 rotated 90 degrees, thereby locking electrodes 7 in the assembly 19. Rotation of the inner electrode locking body 20 to lock the electrodes also locks the inner electrode locking body 20 to the outer body 21. This rotation also hides from radial view the structure of slots 3 and 4.

Outer housing 21 may contain mounting flanges 22, fastener holes 23 or other mounting features and may utilize adhesive mounting methods. The inner electrode locking body may include features for relative rotation using a tool compatible with a hex recess 25 or other feature. This two-piece design allows installation of the stationary outer housing 21 to a mounting surface before or after electrode locking and may allow somewhat more secure retention of the electrodes than single-piece designs. There are many variations possible using the inventive concepts disclosed. For example, inner electrode locking body 20 may be used as a stand-alone spacer as a substitute for spacer 1 in previous embodiments. Or the assembly 19 without the mounting flange features 22 may be used as a substitute for spacer 1 in previous embodiments. Inner electrode locking body 19 may be made of two pieces that can rotate relative to each other to allow one electrode at a time to be captured. One-way features may be incorporated into the interior of assembly 19 so that rotation of inner electrode locking body 20 relative to outer housing 21 is possible only in the locking direction. The use of keyed tool/fastener interfaces may also make the system more resistant to tampering.

Figure 17:
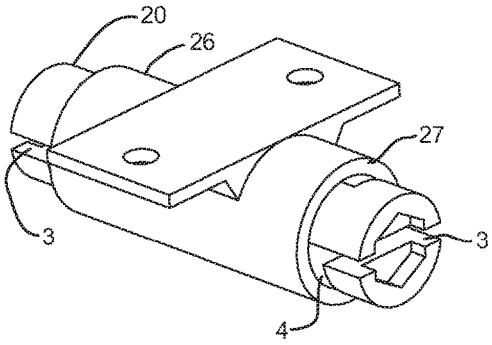
FIG. 17 is an isometric view of another embodiment of a two-piece quarter-turn spacer with mounting flange.
Figure 18:
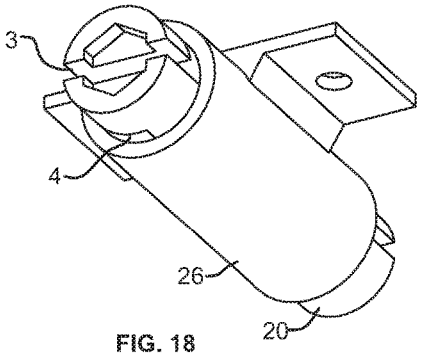
FIG. 18 is another isometric view of the two-piece spacer of FIG. 17.

FIGS. 17 and 18 (top and bottom isometric views, respectively) show an embodiment of a two-piece spacer design with an outer housing 26 that has end faces 27 positioned inward of the locking features of inner locking body 20. As in the previous example, rotation of the inner electrode locking body 20 to lock the electrodes also locks the outer body 26 to the assembly. No radial alignment of the inner and outer housing is required for installation of electrodes in this embodiment.

Figure 19:
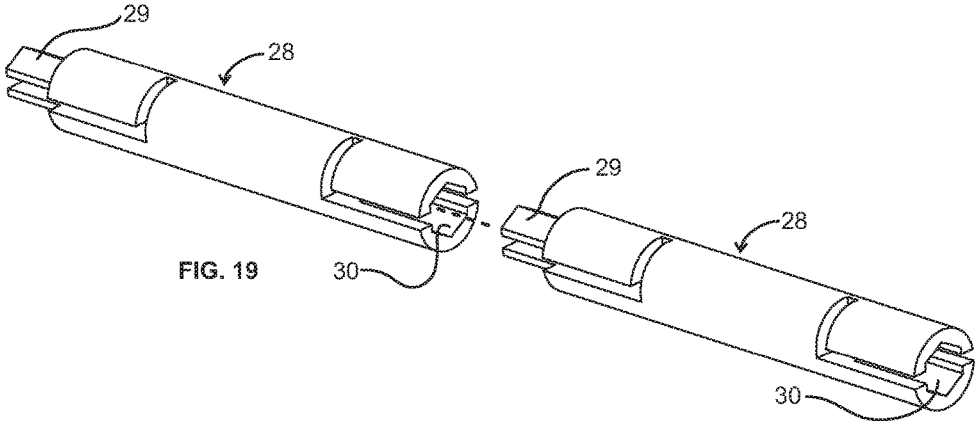
FIG. 19 is an isometric view of an embodiment of quarter-turn spacers that may be coupled end-to-end.
Figure 20:
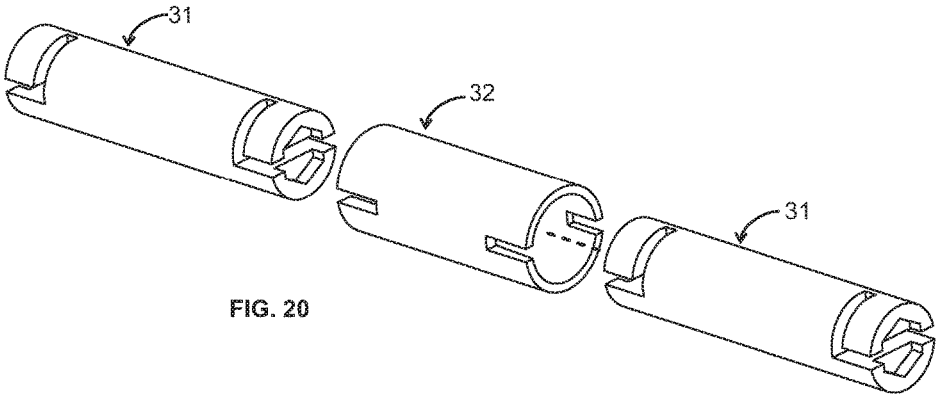
FIG. 20 is an isometric view of an embodiment of quarter-turn spacers that may be joined with coupler components.

Spacers may be attached to one another to create more than two locally parallel electrodes. Spacer 28 with integrated end connecting features 29 and 30 is shown in FIG. 19. Spacer 28 may contain male connecting features 29 and female connecting features 30. Different lengths of spacers 28 and resulting electrode pitches may be implemented. One or more electrodes may be inserted into the slots in the connecting features before the two spacers are joined. Segments without features for electrode retention may also be inserted between spacers with electrode retention features. FIG. 20 illustrates a spacer 31 that uses a separate spacer joining body 32 to join two spacers 31 end to end.

Figure 21:
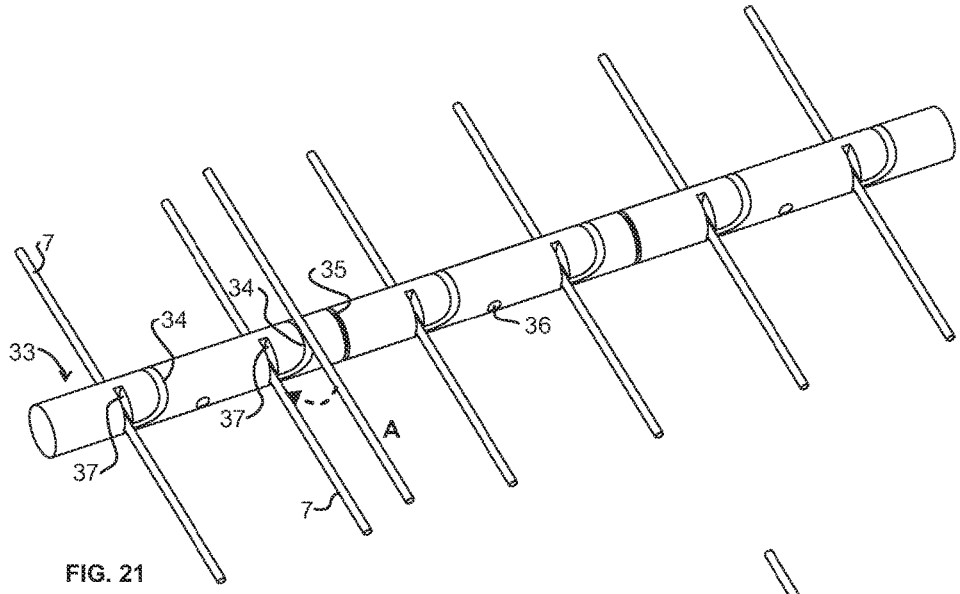
FIG. 21 is an isometric view of extended quarter-turn electrode spacers with slots configured to allow radial assembly of electrodes to track, showing electrodes installed to the bottom of curved slots.
Figure 22:
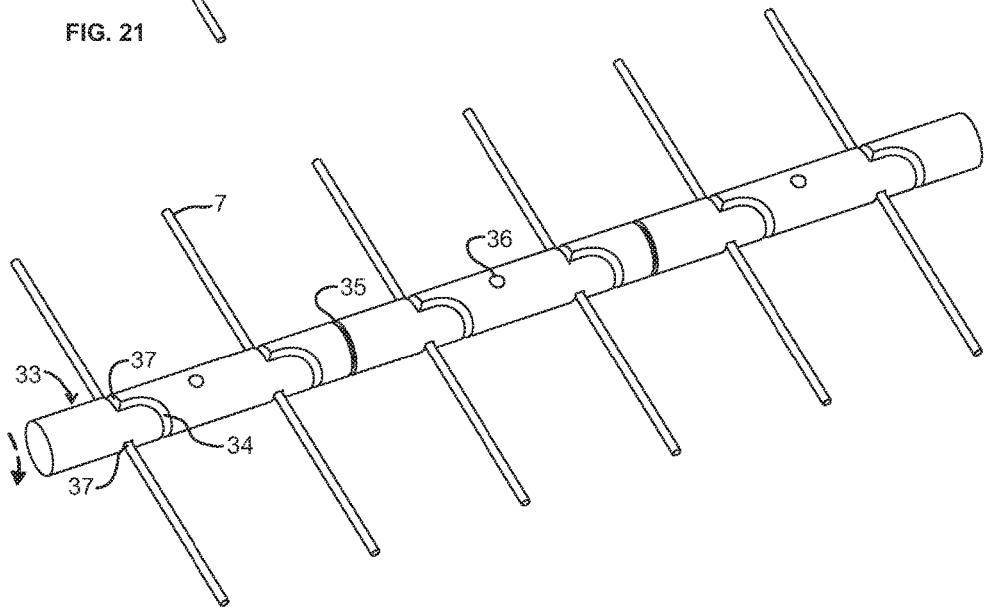
FIG. 22 is the same isometric view of FIG. 21 with electrode spacer rotated to lock electrodes.

In addition to the spacer designs described above in which the electrodes are installed into radial installation slots on the ends of the spacer, FIG. 21 and FIG. 22 illustrate an embodiment in which electrodes 7 may be inserted along the length, or tangentially, to a multi-position spacer 33. In this embodiment, a tangential insertion slot 34 is included. In the illustrations of FIGS. 21 and 22, this tangential insertion slot is a curved slot, extending approximately half way through the diameter of the spacer. The tangential insertion slot 34 terminates into a 90-degree locking slot 37, similar to previous examples. FIG. 21 shows electrode 'A', located adjacent to curved insertion slot 34; the electrode 7 is guided into insertion slot 34 until it abuts locking slots 34 as indicated by the arrow. Spacer assembly 33 is then rotated 90 degrees as indicated by the arrow to lock all of the electrodes 7 in position as shown in the rotated, locked position of FIG. 22. Other features such as break-apart separation feature 35 and mounting holes 36 may be included in spacer 33. Holes 36 may also be used for application of a tool to rotate spacer 37 into the locked position. As illustrated this tangential insertion slot 34 is oriented at a right angle at the outer surface of the spacer 33. This orientation of the slot provides locking with axial rotation of the one or more spacers as indicated by the dashed arrow. As the spacers 33 are rotated, the electrodes move toward the axis of the spacer and to the left. Tangential entrance slots are also possible that are not at a right angle to the spacer axis, but would introduce a need for a spacer rotation that is not purely along the spacer axial direction and/or relative translation.

It is not necessary to have the electrodes enter radially oriented slots located on the ends of the spacer in preparation for locking through axial rotation. For example, FIG. 21 illustrates an embodiment where the slot entrances are located tangentially to the spacer. Translating the spacer relative to the electrodes guides the electrodes from this tangential slot entrance until they are positioned at the longitudinal axis of the spacer in preparation for the locking step shown completed in FIG. 22. In this example, the tangential slot entrance is perpendicular to the axis of the spacer, and the electrodes remain perpendicular to the axis of the spacer throughout the assembly steps. The inner electrode spacing does not have to change during the process. As a three-step alternative (not shown), the slot entrance could be oriented at an angle to the circumference of the spacer and extend down to the axis of the spacer. A rotation of the spacer about an axis perpendicular to the plane of the electrodes as a second step could be used to orient the electrodes perpendicular to the axis of the spacer in preparation for the final locking rotation about the longitudinal axis of the spacer.

Other slot shapes and combinations of relative movements for the orientation and locking steps are possible. The locking slot orientation does not need to be one in which axial rotation of the spacer is possible without any movement of an electrode relative to its position along the length of the spacer. It is possible to have a locking slot that has relative movement of the electrode along the length of the spacer, for example, with a slot with a spiral shape. The use of spiral slots may be used to increase the degree of twist in the locking step. Spiral slots may also be used to essentially combine the presentation and locking steps into a single continuous motion by having the spiral insertion slot flow into the spiral locking slot without an angular discontinuity. That is, although the electrodes will be moving relative to the axial position of the spacer, the spacer will only be rotated axially to both capture and lock even with a changing pitch in the spiral.

Figure 23:
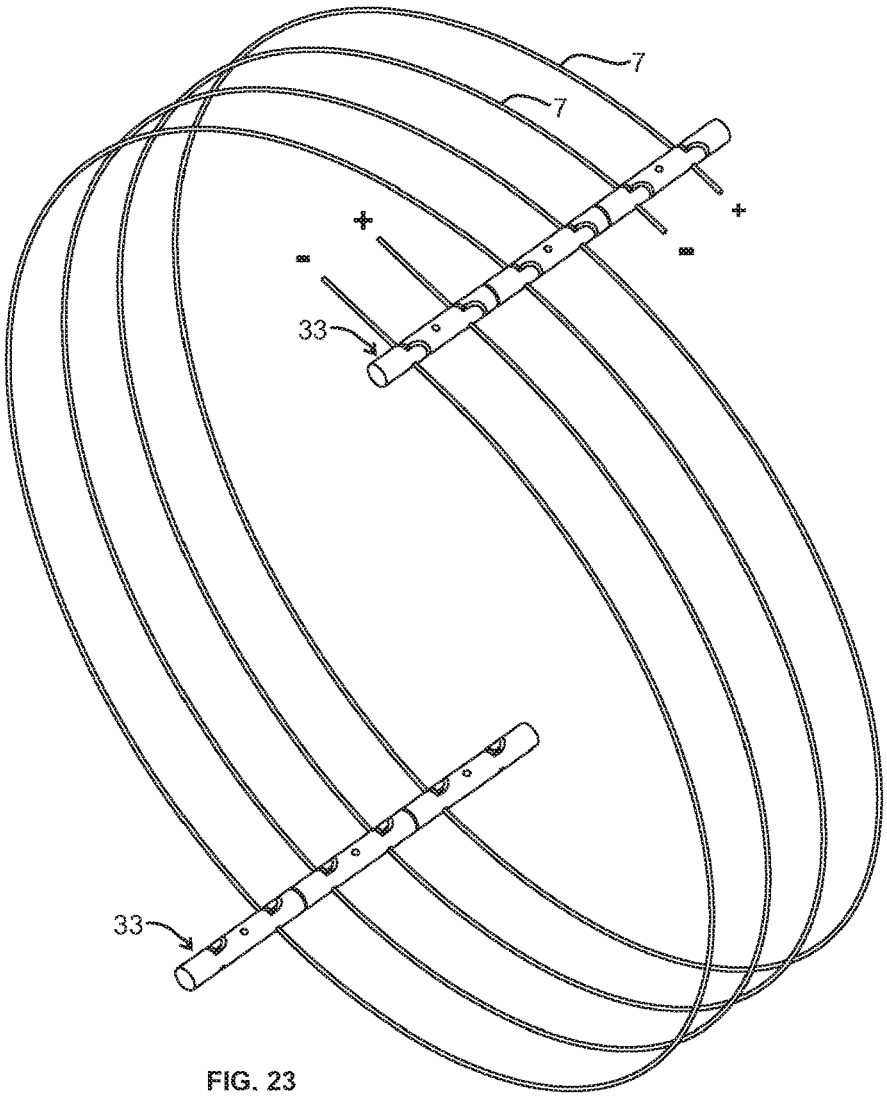
FIG. 23 is an isometric view of the electrode pacers of FIG. 22 showing curved, formed alternating electrodes.

Using flexible or semi-rigid electrodes, freestanding complex compound 3-dimensional electrode assemblies may be constructed with this combination. FIG. 23 illustrates a spiral two-electrode and spacer 33 assembly. With a DC voltage applied to the two electrodes, lighting fixtures may be attached across any two adjacent electrodes. Fixtures designed to use alternating current would require no fixture orientation for attachment between any adjacent electrodes.

Figure 24:
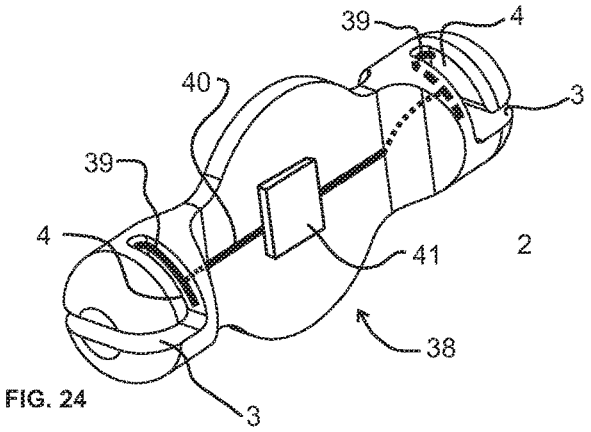
FIG. 24 is an isometric view of a quarter-turn substrate with electrical contacts and electrical devices incorporated into the substrate.

The embodiments above disclose a twist-on spacer that mechanically locks the electrode wires in a locally parallel configuration. This configuration may be used for creating a twin-lead ladder line antenna or for cable lighting systems using separate lighting fixtures which are mechanically and electrically attached to the electrode by other means. FIG. 24 illustrates a lighting fixture embodiment that provides electrical attachment to the electrodes in addition to the mechanical attachment of the twist-on spacer embodiments above. As before, lighting fixture 38 includes insertion slots 3 and electrode locking slots 4 for mechanically attaching two electrodes simultaneously by rotating fixture 38 around its axis. Included in each electrode locking slot 4 is an electrical attachment terminal 39. These provide an electrical circuit path between the two electrodes (not shown) through wiring 40 to power electrical energy consuming device 41, such as an LED or other light emitting device in the case of a cable lighting system. When used with bare (uninsulated) electrodes, terminal 39 may be a spring member or a conducting surface treatment on the slot surface depending upon the degree of interference between the locking slot 4 and electrode 7.

In the case of electrodes having an outer electrical insulation, terminal 39 may incorporate an insulation displacement contact or "IDC". Generally, an IDC version of terminal 39 for a cylindrical cable would include a sharp edge oriented to cut through the insulation and contact the electrode as the fixture 38 is rotated relative to the insulated electrode. Non-limiting examples include one or more metal edges oriented perpendicular to the electrode that cuts through the insulation at the end of slot 4, or an edge oriented at an angle to the slot 4 that slices through the insulation and slides along some longitudinal distance of the electrode 7 over a portion of the locking rotation.

Insulation displacement contacts can also be used with parallel suspended insulated electrodes that are held in place with the insulated spacers described previously using magnetically attached fixtures or fixtures that are attached to electrodes by mechanical forces using springs, wedges, bolts, screws or other non-magnetic gripping or clamping elements. Magnetic and mechanical attachment systems for IDC electrodes preferably have forces between module electrical contacts and electrodes that are directed generally perpendicular to the contact surface of the electrode.

Figure 25:
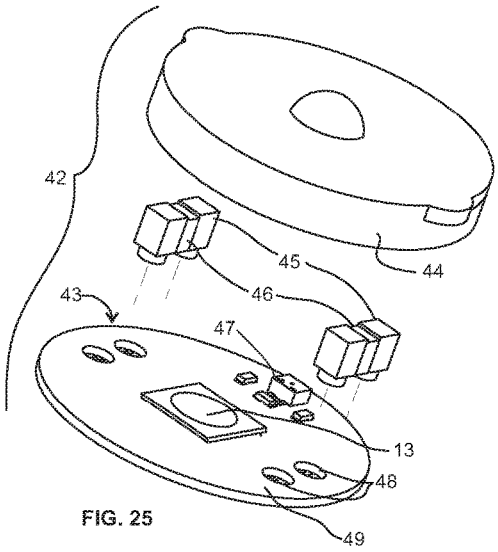
FIG. 25 is an exploded isometric view of a magnetic electronic module such as a lighting puck.
Figure 26:
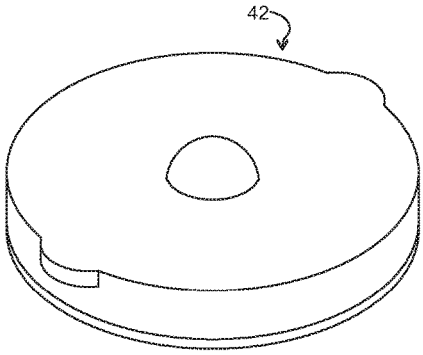
FIG. 26 is an assembled top isometric view of the puck of FIG. 25

FIGS. 25 to 28 illustrate a magnetically attached lighting puck with IDC connection that is compatible with insulated electrodes that are ferromagnetic. FIG. 25 is an exploded view of a magnetic puck assembly 42 that comprises LED 13 mounted to an electronic circuit assembly 49 and top housing 44. Light from the LED 13 is transmitted through the top of housing 44. The magnetic attraction for mechanical retention and electrical contact with each electrode is illustrated as a magnetic assembly comprising a magnet 46 and two pole pieces 45. Preferably the magnetic assembly is loosely constrained and the contact pad is affixed to a compliant substrate to accommodate mechanical variation in the electrical connection as described in co-owned U.S. Pat. No. 9,300,081 and pending U.S. patent application Ser. No. 15/010,605 which are hereby incorporated by reference in their entirety. This arrangement results in an efficient complete magnetic flux path between the lower tips of the pole pieces through the electrode, although other configurations of magnetic connectors may be used. Strip electrodes are preferred over round electrodes for magnetic IDC attachment. Strip electrodes may be of approximately rectangular shape having widths comparable to the widths of the contact pads of the puck and of sufficient thickness for system mechanical stability and to avoid magnetic flux saturation. Strip electrodes are not required to have parallel edges. Since the strip electrode width and thickness are not equal, a twist-on spacer for strip electrodes would generally require asymmetrical electrode attachment features. Specifically, for a spacer similar to the first embodiment above, the entrance slots 3 would be sized for the smaller strip electrode thickness and locking slots 4 would be larger to accommodate the larger strip electrode width. Spacers for suspended parallel strip electrodes are not limited to the twist on embodiments for cylindrical electrodes described previously for use with IDC or uninsulated strip electrodes. Other embodiments for twist on spacers will be described below.

Figure 27:
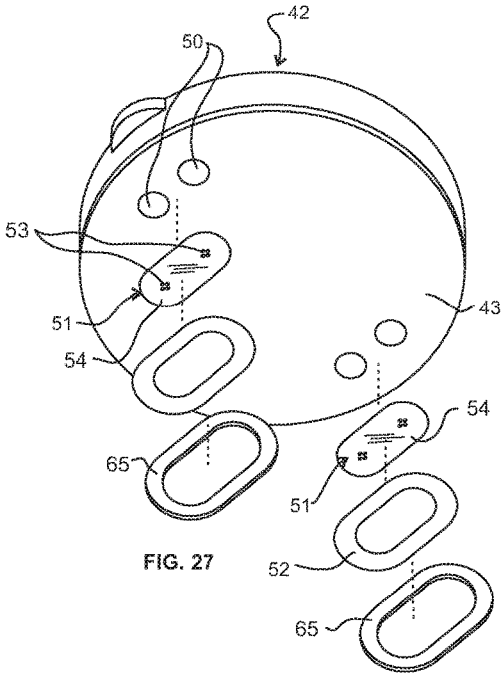
FIG. 27 is an exploded isometric view of the magnetic puck of FIG. 25 and FIG. 26 showing IDC and gasket components.
Figure 28:
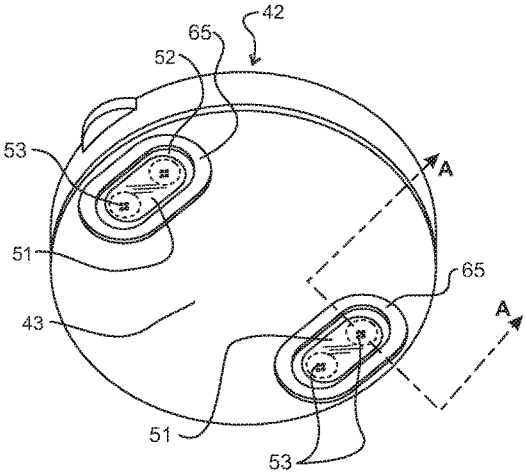
FIG. 28 is an assembled isometric view of the puck of FIG. 25 through FIG. 27.

As illustrated in FIGS. 25 and 27, puck 42 includes flexible magnetic contacts 50 that extend across apertures 48 in electronic substrate 49. As a result, the electronics located in the interior cavity of the puck can be easily sealed from the outside environment by bonding the interface between the substrate 49 and housing 44. Other forms of contacts and pucks can also be sealed from the environment and are compatible with the IDC connector system described below.

Figure 29:
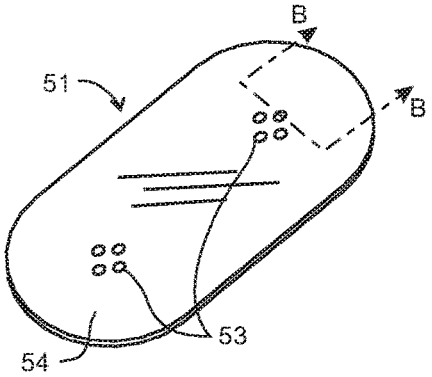
FIG. 29 is an isometric view of an IDC plate with pierced IDC features.
Figure 30:
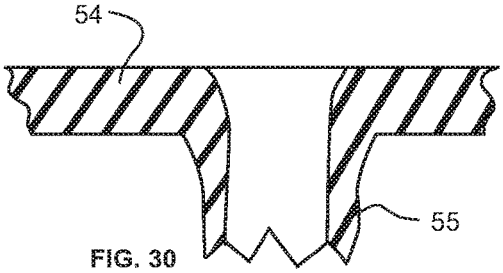
FIG. 30 is a magnified cross-sectional view of the pierced IDC features of FIG. 29.
Figure 31:
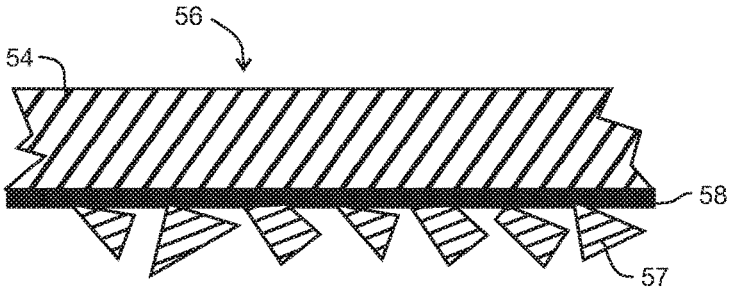
FIG. 31 is a cross-sectional view of an IDC component comprised of conductive sharp particles.
Figure 32:
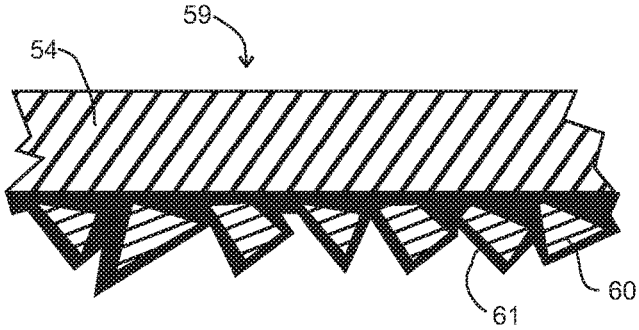
FIG. 32 is a cross-sectional view of an IDC component comprised of conductively plated sharp particles.

FIG. 27 shows the electrical contact pads 50 on the bottom of the puck 42. These contact pads 50 are shown as discrete features, but in some embodiments they may be continuous or in electrical continuity. The IDC connector system in this figure is an optional feature of puck 42. IDC plate assembly 51 comprises a substrate 54 with IDC features 53. For example, IDC plate assembly may be made from a piece of stainless steel, phosphor bronze or other metal. The IDC plate assembly may extend across multiple contact pads as illustrated or may be sized to make physical and electrical contact with only one contact pad (not shown). The IDC plate assembly 51 may be attached to the bottom of the puck 42 using adhesives or other forms of mechanical attachment. The IDC plate may also be magnetically attached if constructed of materials that are attracted to a magnet. FIG. 27 illustrates a self-adhesive tape to attach the IDC plate. Some advantages of an optional IDC plate that is attached with self-adhesive tape is that a single module can be used for both non-IDC and IDC electrodes, IDC features on the plate can be optimized for different electrode insulations and a module with a damaged IDC plate can be easily repaired. As illustrated, the tape may be cut to form a perimeter attachment 52 around the outer edge of the IDC plate assembly with IDC features 53 positioned on contact pads 50. Optional compressible gasket 65 may be used to form an environmental seal around the perimeter of the contact area, for example, to provide a water-resistant connection of a module to an insulated strip electrode in an outdoor environment. As shown in FIG. 29 and FIG. 30, the IDC features may be formed by piercing IDC substrate 54 to create an array of sharp hollow spikes. For example, the IDC plate may be made from approximately 0.002-inch-thick stainless steel, or phosphor bronze, with IDC features formed by piercing with pointed 0.025 diameter piercing tools. The resulting IDC features are approximately 0.01" tall, 0.025" diameter protrusions with sharp asperities, similar to the features found in some rasp citrus zesters. Other types of sharp pierced and/or formed structures in the sheet metal are possible, such as the small pierced and formed triangular spikes of FIGS. 40-41. Alternately, composite IDC plate assembly 56 may comprise a distribution of sharp conductive particles 57 bonded to a conductive plate 54 with bonding layer 58 as shown in cross-section in FIG. 31. The sharp conductive particles 57 may be metal or metal coated ceramics or metal coated glass. FIG. 32 shows an IDC plate assembly 59 cross-section where sharp conductive or metal-coated non-conductive particles are bonded to a conductive plate 54 through a plating or plasma spray process. Sharp surface structures could also be formed by subtractive processes such as photolithography or by plasma etching. These sharp structures pierce the electrode insulation and form an electrical conduction path through the electrodes, fixture contacts, wiring and the light-emitting element.

Strip electrodes are preferred for magnetic attachment to maximize the contact area overlap between the IDC pad and the electrodes and to increase magnetic forces. Strip electrodes comprising ferromagnetic materials may be used in planar magnetic track lighting systems. These planar magnetic track lighting systems differ from the suspended electrode systems described above in having the strip electrodes mounted in a parallel configuration to a continuous electrically insulated substrate instead of held in place by periodic spacers. More than one pair of strip electrodes can be employed in a planar array to allow modules to be mounted in different locations on the planar surface. U.S. Pat. No. 4,578,731 describes geometries allowing random module placement in planar electrode arrays which may be used with the planar electrode systems disclosed herein. The magnetic IDC pucks disclosed here are compatible with suspended strip electrode systems and planar magnetic track systems.

FIGS. 33 and 34 illustrate the connection of the puck 42 with perimeter seal IDC assembly to a magnetic track through a cross-section (equivalent to AA on FIG. 28) taken directly through pierced spike features 55 on opposite sides of the puck. Two parallel ferromagnetic strip rails 62 are shown cut in a direction perpendicular to their length. The rails 62 are mounted on an insulating substrate 64 and covered with an electrically insulating layer 63 such as a vinyl, polyester, silicone or other soft polymer or elastomeric electrically insulating film or coating, insulating paint, electrophoretically applied insulator, or other dielectric coating. Use of a soft polymer film is preferred since these films may be selected to be "self-healing" when a connected module is removed, that is, to have the previously displaced insulation flow back into the volume that was occupied by the IDC contact structure. For moist environments, it may also be desirable for insulating layer 63 to have a hydrophobic surface characteristic. This characteristic may be a fundamental material property or achieved through secondary coating or surface treatment processes. This is preferable when the insulating layer extends between electrodes to minimize the potential for electrical conduction through condensation.

The puck assembly 42 in FIGS. 33 and 34 is generally as described in FIGS. 25-28 and includes optional compressible gasket 65 which surrounds the IDC plate. This gasket is preferably sized to be smaller than the width of the strip electrode. As puck 42 approaches the rails 62 as shown in FIG. 33, magnetic flux from permanent magnet 46 flows through pole pieces 45 and through ferromagnetic electrode 62. The magnetic attraction force pulls the puck towards the rails in the direction perpendicular to the contact faces of the electrodes. This magnetic force causes IDC spike feature 55 to pierce insulation layer 63 forming a conductive path from the rail 62 through the IDC assembly 51 to the puck contacts 50. The magnetic force also compresses gasket 65 made of a soft elastomer that surrounds the electrical path between the rail and puck in the direction perpendicular to the contact faces of the electrodes. The use of the optional gasket provides a system that is environmentally sealed. After the electrical connection is made, the magnetic force will continue to apply force on the IDC spikes 55 to make reliable electrical contact with the electrode and maintain compression of the gasket 62. A minimum desired gasket compression amount for sealing can be determined by design of the distance between the top surface of the electrode assembly that contacts the gasket and the bottom surface of the module that touches the gasket.

As illustrated in FIG. 33, the gasket 65 is in direct contact with the bottom of the module substrate 49 and the self-adhesive tape 52 holding the IDC plate to the module substrate is located within the gasket. For sealing purposes in this embodiment, the module is preferably attached to the electrode so that the gasket is compressed uniformly along at least the inner perimeter of the gasket. This is shown in FIG. 34. As the module is attached to the electrodes, the insulation displacement spike features 55 pierce the insulating layer 63 of the electrode 62. Simultaneously, the gasket 65 is compressed between the bottom of the module substrate 49 and the insulating layer 63 of the electrode. The compression of the gasket forms the environmental seal around the electrical path connecting the electrode 62 to the IDC plate 51 to the module contact pad 50 and subsequently to the electrical circuit which includes electrical device 41. In the embodiment shown in FIG. 34, the separation distance between the bottom of the module substrate and the top of the electrode is determined by the IDC plate 51 and the contact 50.

The distance between the magnetic pole piece 45 and the ferromagnetic electrode rail 62, that is, the gap in the magnetic circuit, can be made very small. (The figures are not drawn to scale to better illustrate features; FIGS. 42 to 46 are more representative of the scale.) The small magnetic gap and sharp projections results in high Hertzian stress concentration on the IDC plate/rail interface for higher contact reliability and the magnetic force directly behind the sharp projections maintains contact pressure under typical outdoor temperature changes. The very short electrical path length through the IDC plate assembly 51 relaxes requirements on electrical conductivity of the IDC plate.

FIGS. 35 and 36 show a variation of the above embodiment. Instead of a perimeter seal member 52 and gasket 65, this variation attaches the IDC plate to the bottom of the puck with an insulating tape 66 that completely covers the IDC plate. In this embodiment, the IDC plate 52 and module contact pad 50 are also environmentally sealed before the module is connected to the electrodes. The insulating tape may be, for example, 0.0005 inch to 0.004-inch-thick vinyl or polyester pressure sensitive adhesive tape. As the puck 42 approaches the ferromagnetic rails 62, magnetic force pulls the puck onto the rails. This force causes the IDC plate spike features 55 to pierce both the insulating tape 66 holding the IDC feature to the puck 42 and the insulating layer 63 on the rails 62. In this case, environmental sealing of the assembly results from pressure at the interface between the insulating tape 66 and the electrode insulating layer 63. The IDC plate in FIGS. 33-36 can readily be added or removed from puck 42 by peeling the insulating layer 63 if attached with pressure sensitive adhesives. This may be useful for logistics or field repair considerations. IDC plate structures may also be permanently attached to the module substrate using methods such as curing adhesives and solder. IDC plate structures may also be coated with an insulating material on the outer surface of the plate.

Figure 37:
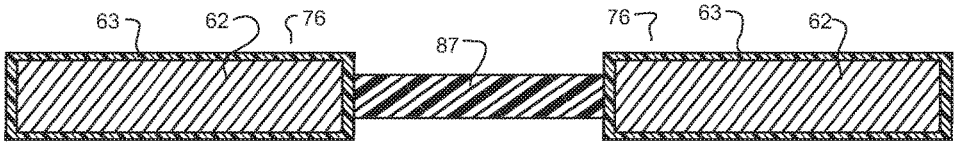
FIG. 37 is a cross-sectional schematic view of an insulated electrode track with insulating spacer.

As an alternative to the mounting of insulated electrodes on one side of a planar surface as shown in FIGS. 33-36, the strip electrodes can be accessible from two sides by using periodic spacers to have electrode strips suspended in space as described for the cable system in FIGS. 5 and 6. In addition, a continuous spacer between electrodes could also be used to form an electrode track system allowing attachment from top and bottom. A cross-section of this is shown in FIG. 37. A continuous spacer 87 is located between insulated electrodes 76 comprising electrodes 62 and insulating layer 76. The spacer may be mechanically attached to the electrodes, for example with adhesive. As shown, the insulating layer extends between the electrode 62 and spacer 87, so electrical isolation between electrodes is provided even if the continuous spacer is electrically conductive.

Figure 38:
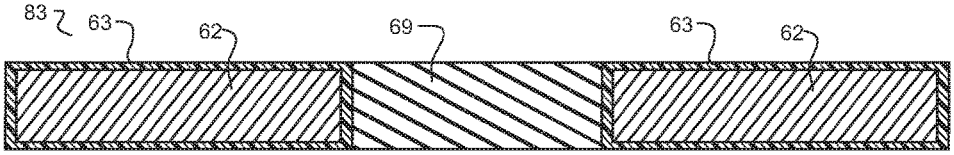
FIG. 38 is a cross-sectional schematic view of an insulated electrode track with a central thermally conductive spacer.
Figure 39:
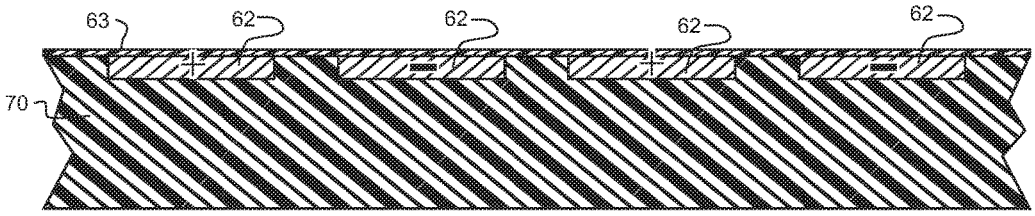
FIG. 39 is a cross-sectional view of an electrode panel with planar embedded electrodes and insulating coating, where electrodes are not visible.

Although the strip rails 62 illustrated extend above the substrate 64 of FIG. 36 or the spacer 87 in FIG. 37, they may also be embedded in the substrate or attached to a spacer to create a flat surface, as shown in FIG. 38 and FIG. 39.

FIG. 38 shows a cross-section of an electrode track where the spacer 69 may comprise a thermally conductive material that may be used to remove heat from a module. Thermal transfer through magnetic attachment of a module is described in co-owned U.S. Pat. No. 8,651,711 and pending U.S. patent application Ser. No. 14/177,227 which are incorporated by reference in their entirety herein. Since surface area is important for thermal dissipation to air, a continuous thermal spacer is preferred over relatively narrow discrete spacers. As long as electrical isolation between the strip electrodes is maintained, the thermal spacer may be attached by adhesives or other mechanical means. The thermally conductive center portion 69 may be made from materials such as aluminum, copper, or thermally conductive polymers that may be used to aid cooling of the attached puck through conduction from the puck substrate to the thermally conductive portion. The thermal spacer may include additional features such as fins, cooling fluids, heat pipes, Peltier modules, or other features to increase heat dissipation from the module.

FIG. 39 shows a cross-section of a series of parallel electrodes 62 embedded substantially flush with the surface of insulating base 70. Insulating base 70 may be a variety of materials such as polymers, solid or composite wood materials, fiber board (such as used in dropped ceiling panels) and sheetrock. When covered with a continuous insulating layer 63, the position of the embedded electrodes may be intentionally obscured for aesthetic purposes.

Although the thickness of the thermal spacer is shown as equal to the thickness of the insulated electrode in FIG. 38, the relative thickness will depend upon the position of the thermal transfer surface of the module and the IDC spikes, the electrical insulation thickness, and the thickness of any separate gasket used for environmental sealing. A portion of the magnetic attractive force provides and maintains the thermal bias on the thermal interface between the module and the thermal spacer. This thermal bias is directed perpendicular to the electrode surfaces. The relative pressure on the thermal interface and the environmental sealing interface is a design choice.

Figure 40:
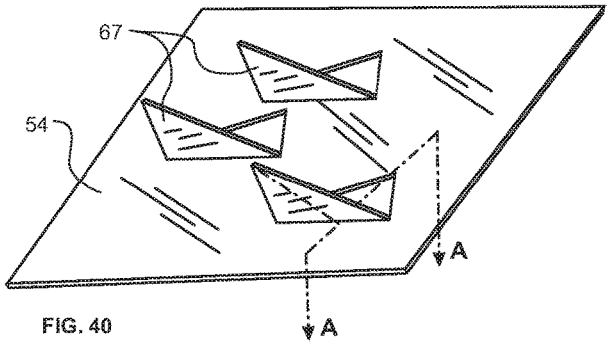
FIG. 40 is an enlarged isometric view of IDC contacts formed by piercing and forming sharp triangular spikes.
Figure 41:
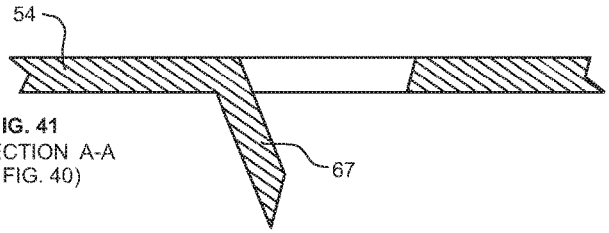
FIG. 41 is a cross-sectional view of the formed IDC features of FIG. 40.

In the embodiments described above, the spikes of the IDC plates were formed by piercing a thin metal sheet with a small sharp cylindrical tool. These spikes are essentially cylindrical with multiple teeth that punch through the insulation layers. Many geometries of IDC spikes may be formed on plates and other forms of IDC plates and spikes can be used in a similar manner to those described above. By way of example, FIGS. 40 and 41 show a pierced and formed IDC contact spike 67 that may be manufactured by punching and forming metal IDC substrate 54 to produce small sharp triangular ICD contacts. Other methods to produce IDC contact spikes 67 include laser-cutting, or chemical-etching openings in substrate 54 and subsequent mechanical forming of contacts 67. After an IDC spike penetrates the insulation and physically contacts the electrode surface, some deflection of the spike is expected as the applied force increases. A small deviation from perpendicular spike orientation relative to the plate may be used to reduce the effect of mechanical tolerance on spike height by allowing some deflection of the spikes. This contact wiping of the spike on the electrode surface may also remove oxide layers on a microscopic scale. As before, environmental sealing of the connection around the spike results from compression of the electrical insulating layers between the flat portions of the IDC plate surrounding the spike and the electrode in a direction perpendicular to the electrode contact surface.

Figure 42:
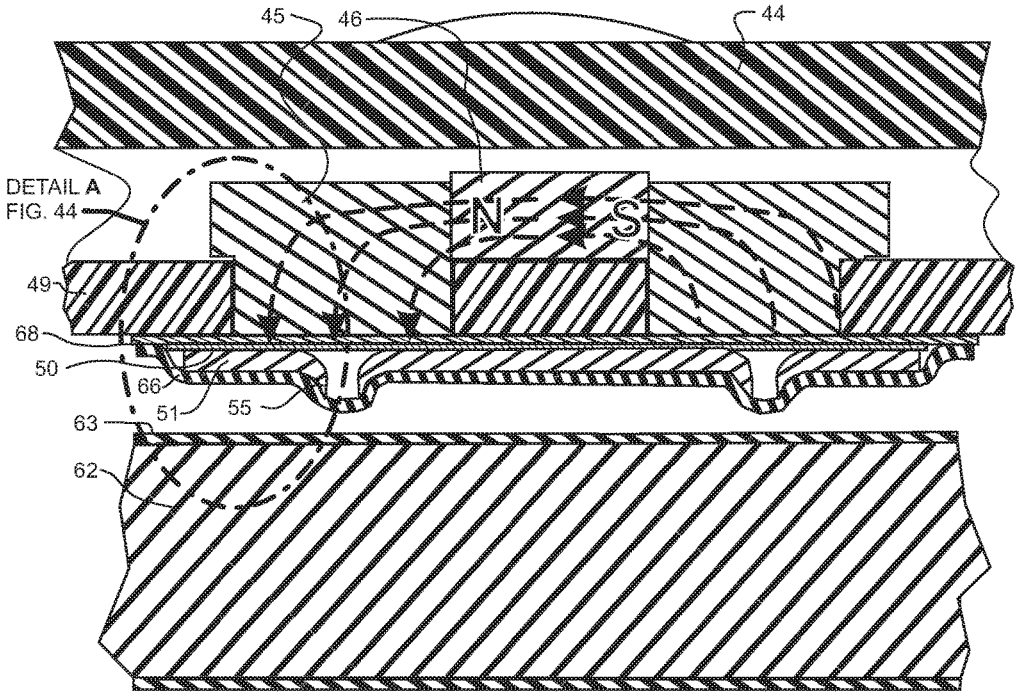
FIG. 42 is a cross-sectional view, unmated, through the magnetic components, IDC contacts and electrode of an IDC puck and electrode.
Figure 43:
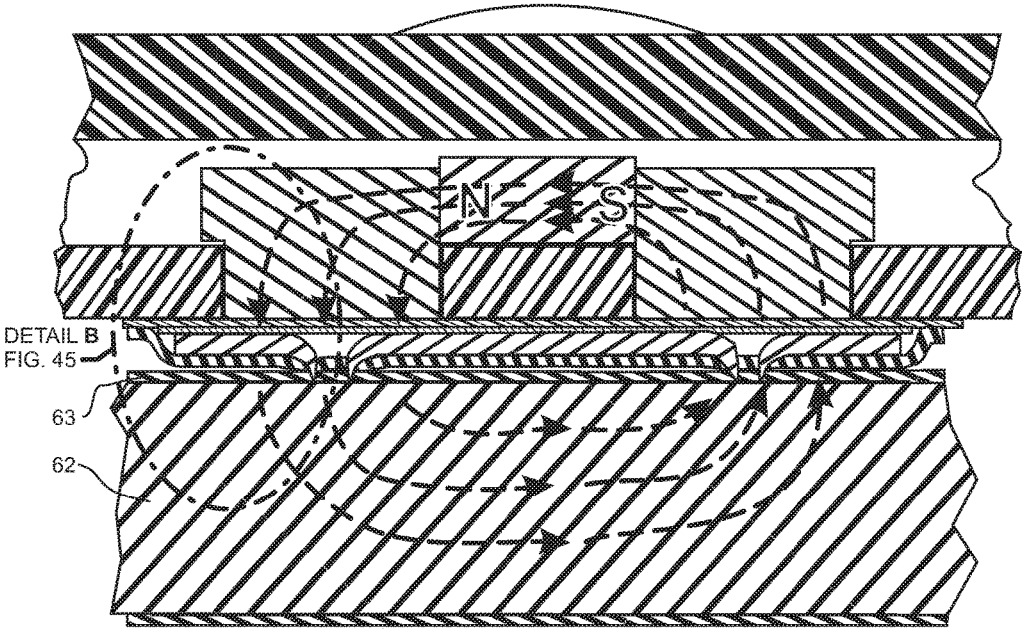
FIG. 43 is a cross-sectional view, mated, through the magnetic components, IDC contacts and electrode of an IDC puck and electrode, of FIG. 42.
Figure 44:
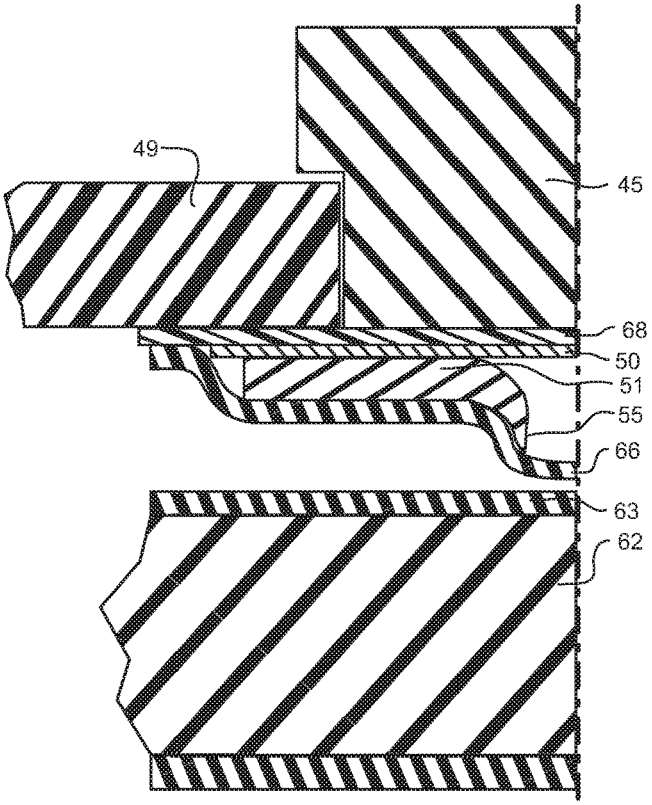
FIG. 44 is a larger detailed cross-sectional view of FIG. 42.
Figure 45:
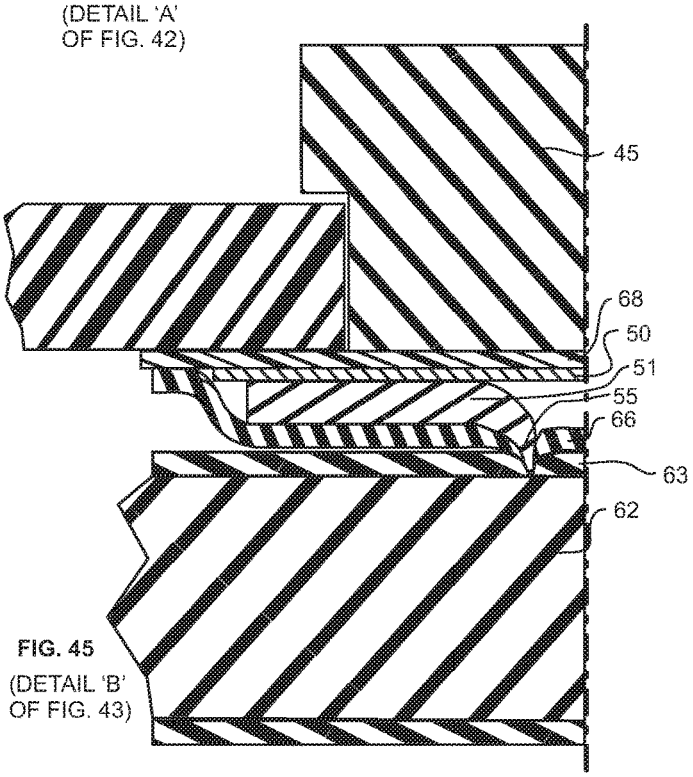
FIG. 45 is a larger detailed cross-sectional view of FIG. 43.

FIGS. 42-45 show enlarged details of this environmental sealing before and after connection with a more representative drawing scale of an axial cross-section. FIG. 42 is an un-mated cross-sectional detail view through the puck's magnetic components and substrate. FIG. 43 shows the mated components of FIG. 42. For clarity, FIG. 44 is a larger detail view (Detail A of FIG. 42), and FIG. 45 is a larger detail view (Detail B of FIG. 43). As shown in FIG. 42, the module contact pad 50 and the IDC plate 52 are located inside of the insulating film 66. An insulating layer 68 is shown located between contact pad 50 and substrate 49. Since the perimeter of the insulating film 66 is sealed to the bottom of the module substrate, the contact pad and the IDC plate are protected from the environment. As the module is connected to the electrode, the insulating layer 66 of the module makes contact with the insulating layer of the electrode 63. As the module substrate moves closer to the electrode, compression between these insulating layers increases until the pressure at the spikes 55 of the IDC plate 51 result in the spikes first piercing the insulating layer of the module 66. Further movement causes the spikes to pierce the insulating layer 63 of the electrode and making the electrical connection between the electrode and the module. Compression of the insulating layers 63 and 66 is highest at the vicinity of the IDC spike 55. Although a gap is shown between the insulating layers away from IDC spike 55, the durometers and thicknesses of these insulating layers may be selected to provide an extended seal surrounding the IDC penetration surfaces with a force directed perpendicular to the electrode surface in a manner analogous to the external gasket embodiment described earlier. Unlike the separate gasketed embodiment discussed previously, the module contacts in this embodiment are less exposed to the environment when not connected and during the connection and disconnect processes. Also since the sealing occurs adjacent to where the spikes pierce the insulating layers, the effective gasket width is smaller, which reduces the requirement of centering the IDC plate on the electrode surface for effective sealing.

Although these figures still show a somewhat exaggerated stepped surface, the bottom of actual modules built of this embodiment appear smooth to the unaided eye and to finger touch. Note that if the IDC contact plates are made in pieces smaller than the apertures 48 in the module substrate, they can be at least partially recessed into these apertures with the flexible contact pad 50 when not connected to the electrode. This recessed geometry generally increases the ability for self-healing of the insulating film 66 when the module is removed from the electrode. Even if the insulating layer 66 does not completely self-heal, that is, to completely flow back to completely encapsulate the very tips of the IDC spikes upon removal of the module from the electrode, sufficient environmental sealing of the interior portions of the module may be retained to meet the predetermined requirements for some applications. As before, design tradeoffs of sealing force versus electrical contact force can be made through the selection of material stiffness and relative geometries generally in these IDC sealing systems. Since the IDC plates can generally move relative to the bottom of the substrate towards the electrode, the position of the shoulder of the ferromagnetic element that contacts the top surface of the substrate at the aperture can be used to control the maximum distance that the IDC plate is pushed towards the electrode surface. Having an insulating layer on both the module and the electrode may be preferred in some system applications to provide sealing of both the module and the electrode before they are connected. single continuous insulating layer of equivalent thickness to the sum of the separate insulating layers located on only one of the module or the electrode could be used instead of the two insulating layers. This single insulating layer system may provide equivalent environmental sealing when the module is mated to the electrode as the two-layer system when the module is mated to the electrode. However, only the portion of the system that has the single insulating layer will be sealed equivalently in an unmated state unlike the two-layer system.

The size, shape and distribution of the sharp IDC structures will depend upon geometries and mechanical properties of the insulated electrodes, insulating tape and the puck to balance environmental sealing force and electrical contact reliability. In addition to the separate plate described above, and illustrated in FIGS. 29-32 and FIGS. 40-41, sharp hard structures may be incorporated directly into puck contact pad surfaces. IDC structures can alternatively or additionally be incorporated on the electrode side of the electrode/module connection.

The magnetic attachment force using the IDC plates is relatively immune from thermal expansion effects through typical environmental changes and manufacturing dimensional variations. Mechanical biasing forces from spring members may relax or vary to a greater extent. However, the IDC plates may also be used with strip electrodes in non-magnetic attachment and biasing systems if these variations are taken into account. For example, similar IDC spike features 55 could be built into the end of a twist-on slot to make a strip electrode version of a fixture similar to that shown in FIG. 24. In this variation, a mechanical bias to force the electrode against the end of the locking slot 4 to make a connection to a contact surface at the end of the slot would be desirable for reliability. A deformable boss, ratcheting ramp or other mechanical locking feature that prevents reverse rotation after attachment may be used. In general, if a separate IDC plate is used, it may also have sharp structures on the surface facing the module contact pad to provide Hertzian stress on both sides of the IDC plate.

FIGS. 42 and 43 are cross-sectional views that are taken perpendicular to the views of FIGS. 35-38 to show the magnetic flux paths. The magnetic poles of the magnet 46 are each positioned adjacent to a side of a pole piece 45. The pole pieces 45 have a portion located above the contact pads 50. The magnet 46 and pole pieces 45 direct the magnetic flux through the path shown in FIG. 43. (Low magnetic flux density paths, for example, from fringing fields in the air gap are not shown.) The IDC plate in this embodiment has spikes 52 located directly under the magnetic pole pieces where the flux density is concentrated. As the module approaches the ferromagnetic electrode, the magnetic flux passes through the electrode and forms a completed flux circuit as shown in FIG. 43. This results in a magnetic force directed perpendicular to the electrode 62 at the spikes 55 located under each pole piece. The electrical contact force direction, the compressive sealing force direction and the IDC spike insulation penetration direction are oriented perpendicular to the electrode contact surface. This magnetic attachment employs a single permanent magnet as the source of magnetic flux that is directed through ferromagnetic pole pieces and a ferromagnetic electrode. Portions of the ferromagnetic elements could be replaced with one or more additional permanent magnets to increase the flux density without changing the shape of the flux path shown.

The electrical contact pad 50 on the bottom of the module in FIGS. 42 and 43 is illustrated as a continuous structure that extends between and beyond both pole pieces on the bottom surface of the module. The IDC plate 51 is also shown as a continuous structure that also extends between and beyond both pole pieces. When connected (FIG. 43), the contact pad 50, the IDC plate 51 and the electrode are in electrical continuity with one another so that IDC spike assemblies (one under each pole piece) make a single electrical connection between the module and a single electrode of the fixture. Multiple IDC spikes may also be used on each puck substrate contact. Alternatively, multiple electrical connections could be made between the module and multiple electrodes of the fixture could be made by using multiple individual IDC plate assemblies and module contact pads for each connection. In FIGS. 42 and 43, magnetic flux lines are not shown passing through the IDC plate parallel to the bottom of the substrate to indicate that the IDC plate 51 has a relatively high reluctance so that the magnetic circuit is not "short circuited" which would reduce the amount of magnetic flux passing through the IDC spikes 55 and through the electrode 62. Materials such as 300-series stainless steels and copper alloys (phosphor-bronze, beryllium-copper, etc.) with additional passivation platings such as nickel and gold may be used for IDC plates. Various platings such as nickel may also be used to reinforce and harden the IDC spikes. In other words, an extended IDC plate should not be made of a ferrous material with sufficient mass to act as a "keeper" that carries all or a substantial portion of the available flux of the magnet. Use of IDC plates that have lower magnetic reluctance may be used if they do not bridge between the magnetic pole pieces of the module. Use of such materials as a plate or other structure may be desirable as described in previously referenced U.S. Pat. No. 9,300,081 to reduce the magnetic separation distance, i.e., the magnetic gap, between the pole pieces in the module and the electrode when relatively thicker gaskets or insulating layers are used.

Although module electronic substrate 49 has been described as a printed circuit board, the electronic substrate may be comprised of metallic or polymer structures with a flexible-circuit or thin circuit board applied thereto, or other circuit board technologies such as molded-interconnect devices and metal-core PCB's.

The embodiments used to illustrate the inventive concepts use modules that can be placed at multiple positions along a linear track with a pair of parallel electrodes. The magnets and the IDC plates in these embodiments were associated with the module. Embodiments that substitute one or more discrete connection positions in a fixture for linear electrodes on a track, or that incorporate the magnet into an electrode fixture instead of the module or that have the IDC spikes built into an electrode fixture to achieve similar results are possible.

Figure 46:
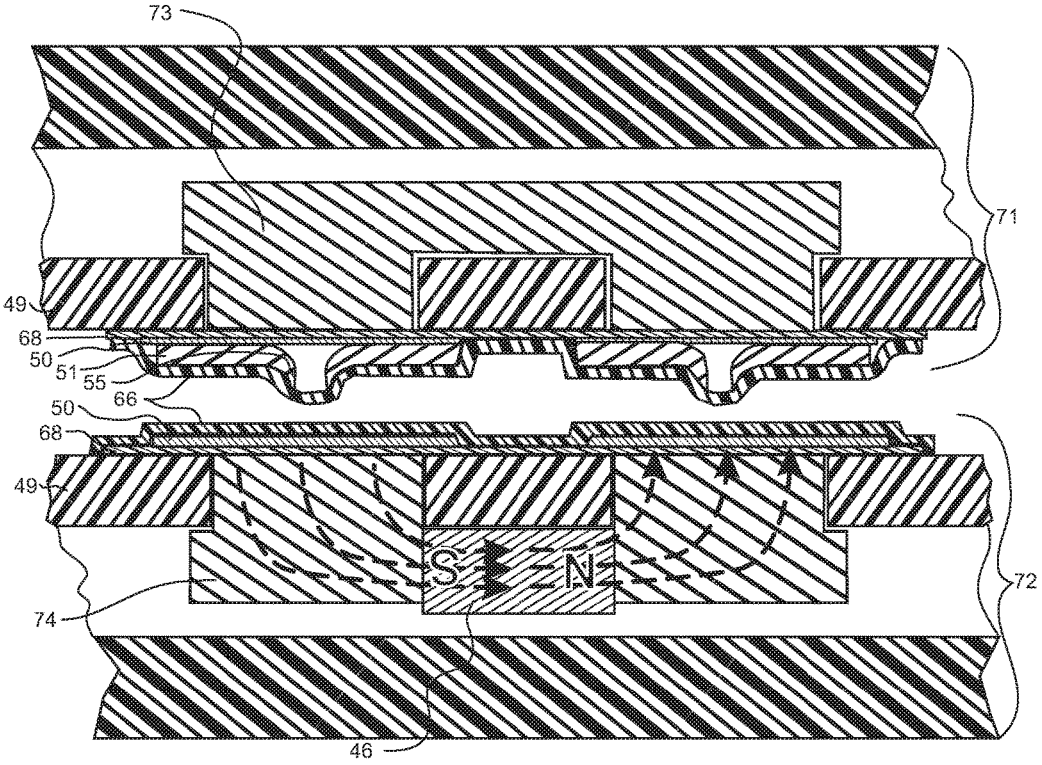
FIG. 46 is a cross-sectional view, unmated, of an IDC module with movable ferromagnetic armatures and substrate with a substrate containing permanent magnet with pole-pieces.

FIG. 46 shows an alternate configuration of a magnetic connection with IDC sealing that may be used for the module and electrode track systems above, or more generally to connect a module to a fixture or another module. The figure shows two electrical modules 71 and 72 in an unconnected state. Module 71 may be a lighting module and module 72 may represent an electrode fixture for powering the lighting module, or vice versa. Modules 71 and 72 may also represent a more generic assembly such as an electrical connector assembly and an electronic device. FIG. 46 illustrates two discrete pairs of contact pads 50 to be electrically connected. Module 71 has a U-shaped ferromagnetic armature 73 that is loosely contained in module 71. Adjacent to each leg of the armature 73 are a contact pad and an IDC plate 51 with spikes 55. A continuous layer of insulation 66 covers the contact pads 50 on both of the modules. Module 72 contains a fixed permanent magnet 46 and fixed pole pieces 74. IDC spikes are compressed via the magnetic force through the pole pieces 74 and armature 73. In this embodiment, pole pieces 74 of and magnet 46 of module 72 may be extended linear parts with multiple contact pads 30 positioned along the pole piece 74 faces. Module 71 may then contain multiple armatures 73, with respective contacts 50 positioned along the length corresponding to module 72's pole pieces, thus creating two contacts for each U-shaped armature incorporated. Such structures using fixed magnets and pole-pieces, and multiple armatures may be linear or a variety of shapes of multiple contacts depending on the magnet, pole and armature designs and flux-paths as described in previously cited U.S. Pat. No. 9,300,081 and U.S. patent application Ser. No. 15/010,605. The magnetic assembly of the magnet 46 and pole pieces 74 in module 72 has a U-shaped cross-sectional like that shown module 44 in FIGS. 42 and 43. Connecting this magnetic assembly to the U-shaped armature 73 of module 71 generally provides a more symmetrical magnetic flux path than illustrated in FIGS. 42 and 43.

Figure 47:
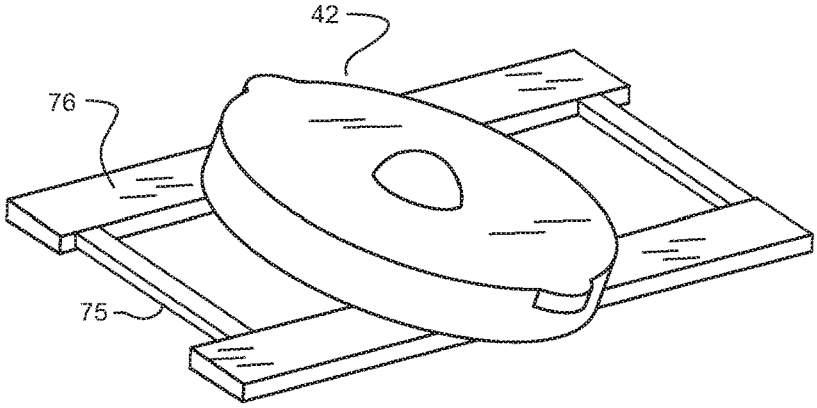
FIG. 47 is an isometric view of an IDC puck on an open track electrode with insulating spacers.

FIG. 47 shows a module attached to a strip electrode track comprising parallel electrodes coated with an insulating layer 76 with spacing maintained by spacer bars 75 located periodically along the track axis. The discrete spacer bars 75 are preferably electrically insulating and may be mechanically attached to the electrodes, for example, using adhesives. Two spacers are shown separated by a spacing along the track on the order of the puck diameter, but the spacing is a design choice. Continuous spacers and spacers with decorative elements may be used. The spacer bars may also be mechanically attached to the electrodes using variations of the rotating spacers described earlier or other mechanical means including but not limited to snap fittings, magnetic attraction or mechanical fasteners such as rivets, bolts, screws, heat-staking, etc.

The cross-sectional view of this track through the insulating spacer 75 would be similar to that shown in FIG. 37 for the continuous insulating spacer 87. In the embodiment illustrated, the electrode insulating film layer 63 may completely surround the strip electrodes. In this embodiment, the spacer 75 maintains the two electrodes at a fixed spacing for attachment of a module to the top or the bottom of the electrode pair.

Figure 48:
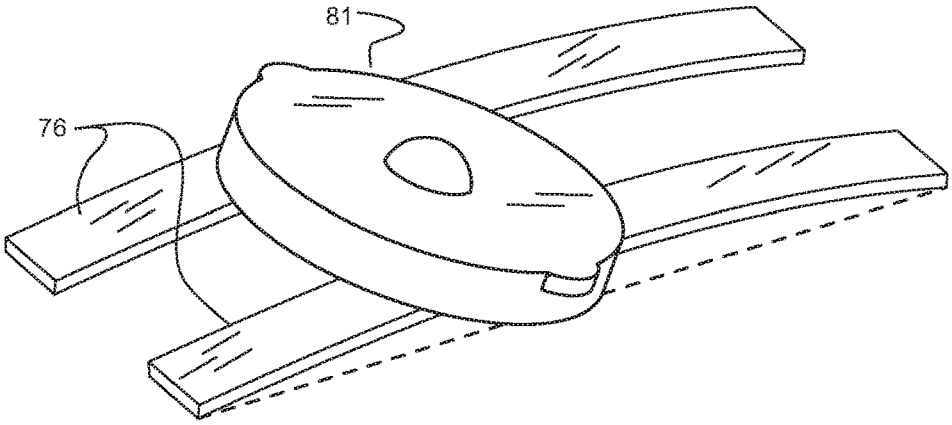
FIG. 48 is an isometric view of an IDC puck on a curved track electrode.
Figure 49:
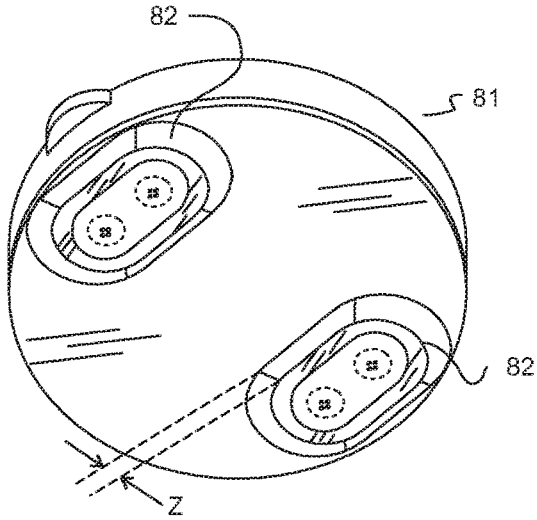
FIG. 49 is a bottom view of an IDC puck with raised contact areas.

The strip electrodes in the embodiments described above were shown as being flat. The IDC modules can be used with electrode tracks having curved contact surfaces as shown in FIG. 48 with an attached module 81. For lighting applications, curved tracks provide some capability to direct lighting modules in different directions. When insulating layers or gaskets of uniform thickness are used, the uniformity of compression of the sealing around the IDC spikes will decrease with decreasing radius with curved strip rails. Depending upon the curvature of the rails, the bottom of the module 81 may include raised portions 82 in the vicinity of the contact pads as shown in FIG. 49 to prevent the periphery of the module from physically contacting the electrodes.

The curved track of FIG. 48 provides more directional pointing flexibility than the flat track of FIG. 47. FIGS. 50-54 show an alternate track approach for providing a greater range of additional directional pointing flexibility that maintains the uniform spacing between the bottom of the module and the strip electrode surface resulting in uniform compression of the one or more insulating layers for environmental sealing around IDC spikes. This directional pointing flexibility is obtained by folding of the strip electrodes to form a series of attachment locations along the length of the track characterized by gyrating pointing directions.

Figure 50:
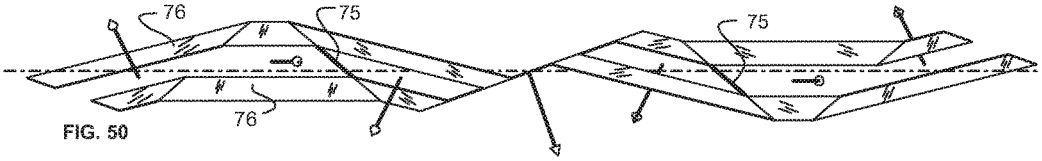
FIG. 50 is a side view of a folded electrode gyrating track with periodic insulating spacers.

FIG. 50 shows a side view of suspended strip electrode version of a folded electrode gyrating track. The composition of this track is similar to that shown in FIG. 47 except for geometric differences that will be described below. The track comprises a pair of strip electrode rails with insulating covering 76 and periodic spacer elements 75 that maintain spacing between electrodes. As illustrated, the spacer elements 75 in FIG. 50 are not oriented perpendicular to the strip electrodes; they are preferably placed in locations where the electrodes are bent. The electrodes are bent to provide a series of module mounting positions that differ in pointing direction in both radial and axial directions as indicated by the arrows in the drawing. These arrows indicate the direction perpendicular to the contact surfaces of the strip electrodes of the track at each mounting position.

Seven pointing directions are shown on seven mounting positions in FIG. 50. The modules may be attached to opposite sides of the track at each mounting position, but the arrows are only shown for a single side mounting for clarity.

Moving from one mounting position to the next in sequence along the track axis, the pointing direction has a radial component that rotates in directions about the track axis in 45 degree increments. The pointing direction also has an axial component that reverses direction with each sequential change in mounting position. For the illustrated embodiment, after moving through 8 mounting positions along the axis, this directional pointing pattern shown repeats.

Figure 51:
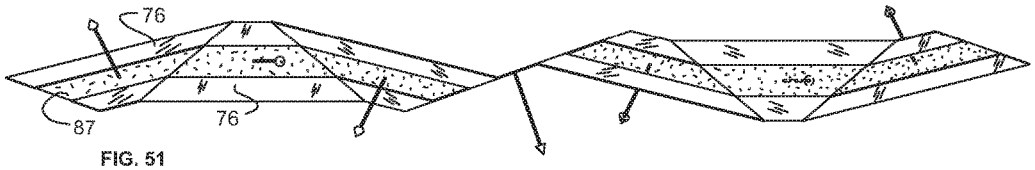
FIG. 51 is a side view of a folded electrode gyrating track with continuous center electrode spacer.

FIG. 51 shows a side view of a version of the folded electrode gyrating pointing direction track that includes the continuous insulating spacer 87 shown in FIG. 37. Substituting the thermal continuous spacer 69 for the continuous insulating spacer 87 would provide a gyrating electrode thermal track of cross-section shown in FIG. 38.

Figure 52:
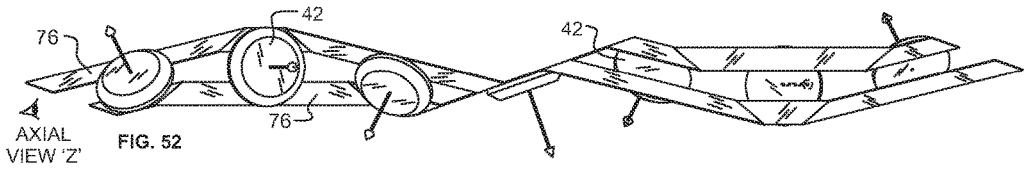
FIG. 52 is a side view of the folded electrode gyrating track of FIG. 50 with magnetic IDC pucks attached to one surface of the electrode track.
Figure 52A:
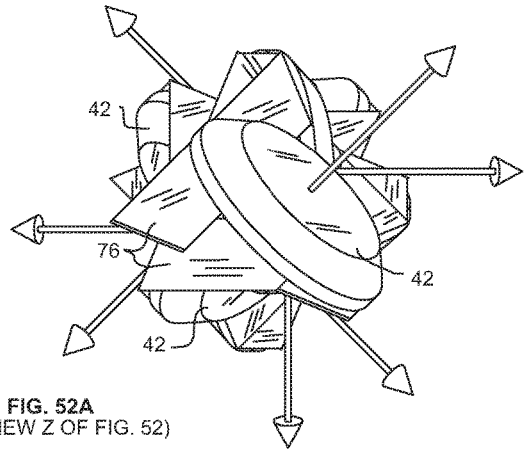
FIG. 52A is an axial end view of the track and pucks of FIG. 52.

FIGS. 52 and 52A show a side view and axial end view, respectively, of the folded strip electrodes 76 with magnetically attached modules 42. The insulating spacers 64 and 87 are not shown for clarity. The modules 42 include LED emitters that are typically characterized by having a maximum emission that is directed from the center top of the module in a direction perpendicular to its top surface. This primary emission direction is aligned with the arrows in this figure. The side view shows how the primary emission direction rotates radially and reverses axially between adjacent mounting positions. The end view of FIG. 52A helps show the range of radial angles provided for the 7 modules shown on FIG. 52.

This end view shows that the axial extent of the folded track is only fractionally larger than the width of the puck 42 and the unfolded flat electrode assembly. The light is emitted in different angles in both axial and radial directions without adding any tilt or rotation mechanisms to the puck. The length of rail material per axial length of the track system is also fractionally increased as a result of the increased path length from folding, but strip rail material cost is typically not a significant factor in track light system cost. Although this figure shows a strip rail track with magnetic coupling and IDC features, adding this directionality capability to round wire electrodes can be readily done. Round wire electrodes, in particular, are characterized by very low cost. The topological conversion from a flat track is not dependent on whether the electrodes are in strip form or cylindrical, whether there are insulating layers or whether there is magnetic attachment.

Figure 53:
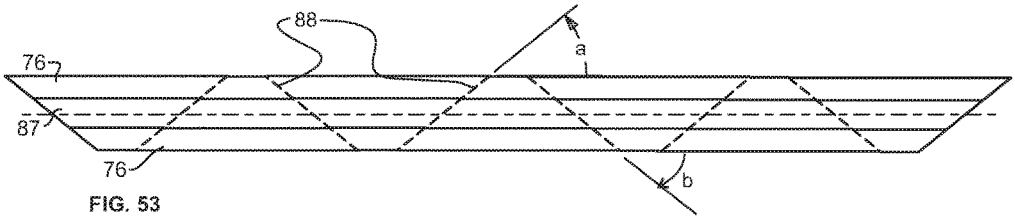
FIG. 53 is a top flat-pattern view of a folded electrode gyrating track showing fold lines.

To demonstrate the simplicity of this structure and to complement the description above of the topology of this folded electrode gyrating track system, the transformation from a flat strip electrode track to the folded strip electrode gyrating track will be described. FIG. 53 is a top view of a flat track of the form of FIG. 51. It comprises a pair of strip electrodes with insulator covering 76 and continuous spacer 87. The geometric transformation is generic and could be used with insulated or uninsulated electrodes of any wire electrode or strip electrode form described earlier using any form of continuous, discrete or thermal spacer between electrodes. Shown on FIG. 53 are a series of dotted fold lines 88. Two of these fold lines are shown to be oriented relative to the axis of the track at angles "a" and "b" respectively. Using the convention from the unit circle in trigonometry, angle a is a positive angle measured counterclockwise and b is a negative angle measured clockwise. In this case, positive and negative denote opposite directions of measurement. To avoid confusion with complementary angles of the unit circle, fold line angles will only be measured in the first and fourth quadrants of the unit circle. That is, the magnitude of fold line angles cannot exceed 90 degrees. In general, the magnitude of the fold line angles relative to the axis may be different from each other. For the track shown in FIG. 51, the magnitude of all of the fold line angles are the same and the direction of the fold line angles alternates in the axial direction. The axial spacing between fold lines may also change generally, but for this track, the spacing is uniform. Having equal fold line angle magnitude, alternating fold line angle polarity and equal axial spacing of fold lines is preferred to provide a more symmetrical track form and uniform gyration. However, variations from these restrictions may be desirable for some applications and are considered to be within the scope of this disclosure.

Since FIG. 53 is a top view, the surface that is visible when flat will be designated the top side, the hidden surface will be designated the bottom side. Top and bottom side designations are associated with the original flat state and do not change with folding. Analogous to the positive and negative angles denoting the direction of the fold line angle measurement relative to the axis, a positive folding direction will reduce the angle between the top surface segments on either side of the fold line from 180 degrees. The resulting angle between the top side surfaces after folding will be designated the top surface fold angle "c". A negative folding direction will reduce the angle between the bottom surface segments on either side of the fold line from 180 degrees. The resulting angle between bottom surface segments at the fold will be designated the bottom surface fold angle "d".

Figure 54:
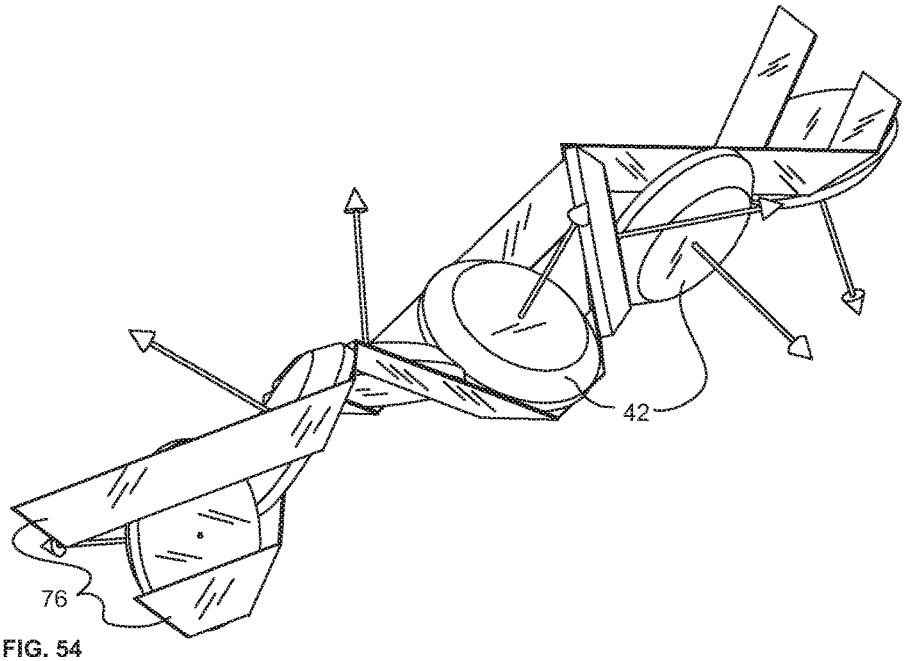
FIG. 54 is an isometric view of the track and puck assembly of FIG. 52.

With these conventions for positive and negative fold line angles and positive and negative folding directions, the actual folding process to go from FIG. 53 to FIG. 51 is straightforward. At each fold line in FIG. 53 that has a positive fold line angle (i.e. like angle "a"), fold the track in a positive direction to create top surface fold angle "c" between top surface segments; at each fold line in FIG. 53 that has a negative fold line angle (i.e., like angle "b"), fold the track in a negative direction to create bottom surface fold angle "d" between bottom surface segments. In general, the magnitude of surface fold angles "c" and "d" that result from folding may be different from one another or may vary at different locations down the track. The structures shown in FIGS. 50, 51, 52, 52A and 54 have the same value for surface fold angles "c" and "d". FIG. 54 is an isometric view of the system of FIG. 52.

The fold line angles and the surface fold angles are design choices. If the fold line angle approaches 90 degrees, some light emission may be blocked by other parts of the track in some mounting positions and the range of radial directions will be limited. If the fold line angle approaches zero, the range of pointing angles relative to track axial distance may become too limited for some consumer applications. Fold line angles of magnitude of about 15 to 70 degrees relative to the track axis are generally preferred. Similarly, if the surface fold angles approach 90 degrees, the track may begin to obstruct some of the emitted light and the amount of electrode material required per axial track length may become impractical. On the other hand, if the surface fold angles remain close to 180 degrees, the range of different pointing directions may be limited for some many lighting applications. Surface fold angles between 110 and 160 degrees are generally preferred. The combination of a fold line angles ("a" of FIG. 53) of 30 to 45 degrees and surface fold angles of 130 to 145 degrees is particularly preferred.

The combination of positive and negative folding directions in the axial direction increases the number of possible pointing directions. Different combinations of positive and negative folding directions, positive and negative fold line angles with varying angle magnitude will result in more complicated gyrations of the track, but they can create track structures that provide a wider range of pointing angles using lighting pucks having no inherent directional adjustment. Although the alternating of fold line angles of equal magnitude and opposite direction coupled with alternating surface folding directions to create equal surface fold angles is preferred to create the compact symmetrical assemblies shown in the figures, other patterns of folding which include sequences comprising positive and negative fold line angles and positive and negative folding directions can be used to create electrode track rail systems with increased axial and radial directional capability.

Figure 55:
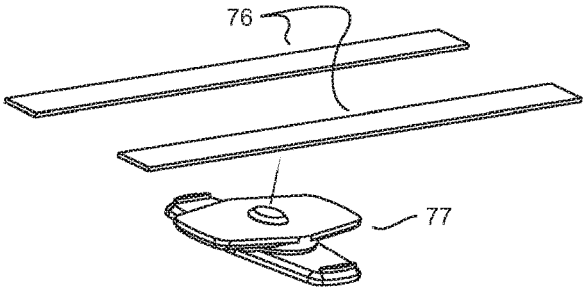
FIG. 55 is an isometric view of a track and rotatable track spacer unassembled.
Figure 56:
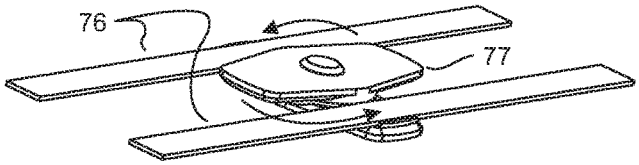
FIG. 56 is an isometric view of the track spacer of FIG. 55 partially assembled between electrode rails.
Figure 57:
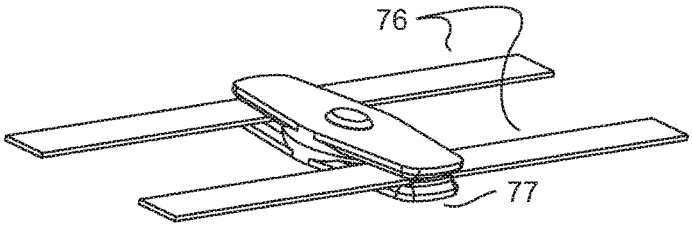
FIG. 57 is an isometric view of FIG. 56 with track spacer rotated to lock spacer and rails.

The folded tracks with gyrating pointing directions are relatively easier to bend in all radial directions during installation. The ease of moving the lighting pucks to different locations for different directional needs on a gyrating track rail is a simple process after the track is installed. The systems above may also be applied to systems that do not employ insulation displacement contacts or do not use strip electrodes. Uninsulated rod electrodes or electrodes formed from a metallic film on one or both surfaces of a faceted support may be similarly formed. Strip electrode track systems that do not employ magnetic forces can also be used for with the folded strip electrode with gyrating orientation tracks to benefit from the directional orientation variation provided. FIGS. 55-57 illustrate an insulating spacer 77 that can be removably attached to a pair of suspended strip electrodes such as the track of FIG. 52 in place of the spacers 75. As illustrated, the spacer comprises two substantially identical elements that are mechanically held together to allow relative rotation. FIG. 55 shows two strip electrodes and the insulating spacer. The two pieces of the insulating spacer are oriented at 90 degrees to one another. FIG. 56 shows the spacer positioned between the two electrodes. The electrodes are positioned to rest against internal surface features of the spacer sized to accept the electrode strip. In FIG. 57, the upper portion of the spacer is rotated 90 degrees to lock the electrodes in position inside the spacer assembly. Beveled surfaces on the spacer may make it easier to rotate the spacer element over the top of the electrode. A spring may be used in the pivot to hold the pieces together around the electrodes, or the spacer elements may be designed to elastically deflect during rotation across the electrodes. The spacers may be designed to grip the electrodes or slide along the electrodes depending upon the relative size of the rails and internal features of the spacers.

Figure 58:
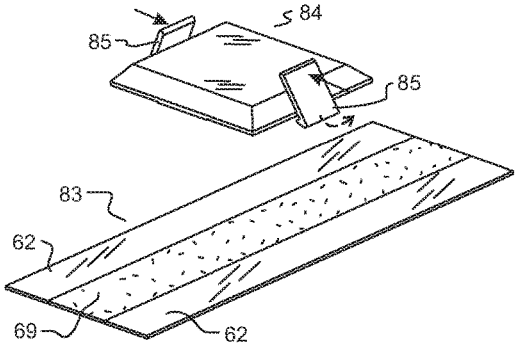
FIG. 58 is an unassembled top isometric view of an IDC module with edge-locking features and thermal interface to the track assembly.
Figure 59:
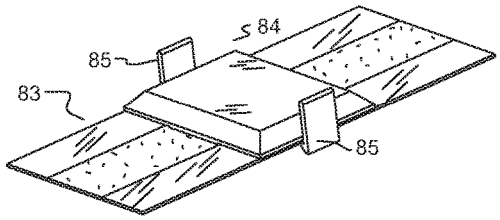
FIG. 59 is an assembled top isometric view of an IDC, of FIG. 58 module with edge-locking features and thermal interface to the track assembly.
Figure 60:
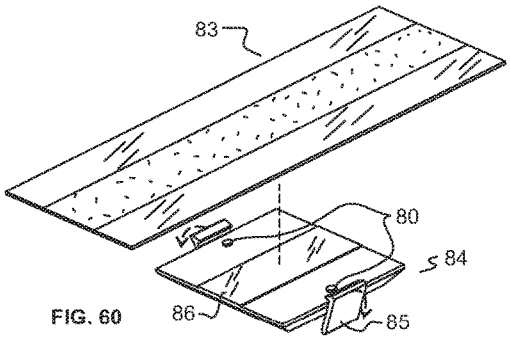
FIG. 60 is a bottom isometric view of FIG. 58.
Figure 61:
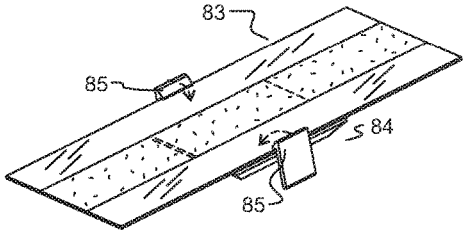
FIG. 61 is a top isometric view of FIG. 59.

The thermal spacer track shown in FIG. 38 can also be used with non-magnetic module 84 mounting as illustrated in FIGS. 58-61. FIGS. 58 and 60 show top and bottom isometric views of a module 84 and thermal track 83 before connection and FIGS. 59 and 61 show the track with module connected. The module has mechanical members 85 that clip over the edges of the electrodes 62. Deflecting elements like springs or elastic members and or ramps may be incorporated into these clips to provide a mechanical biasing force in the direction perpendicular to the plane of the track. Deflecting elements may optionally be incorporated into the module. These deflecting elements push the IDC contacts 80 through any insulation layers in the system at the contact position indicated, press the thermal interface 86 of the module 84 against the thermal spacer 69 and provide an environmental seal around the IDC spikes. Electrical contact, thermal and sealing forces are applied perpendicular to the electrode surface as described above. Mechanical clips can also be used with tracks that do not include spacers. Of course, these mechanical mounting systems could be used with the folded electrode gyrating track of the geometry shown in FIG. 51. The continuous thermal spacer 69 shown in FIG. 38 could also be substituted for the continuous insulating spacer 87 shown in FIG. 51 for thermal management of module 84.

Figure 62:
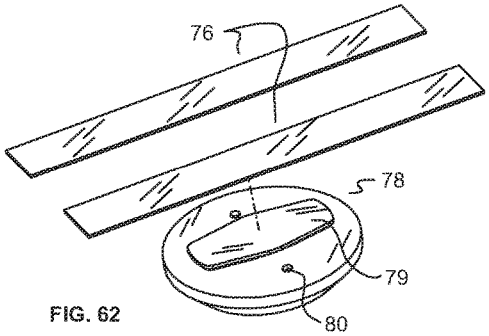
FIG. 62 is an unassembled bottom isometric view of an IDC puck with rotatable spacer and retention feature.
Figure 63:
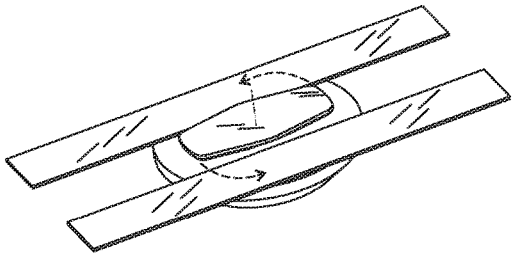
FIG. 63 is a partial bottom isometric view of FIG. 62.
Figure 64:
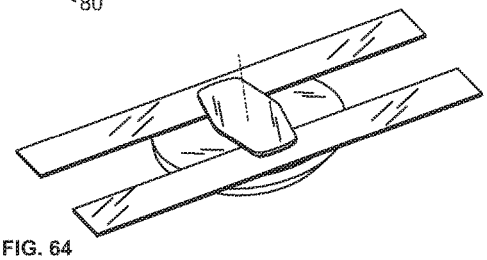
FIG. 64 is an assembled isometric view of FIG. 63, with rotatable spacer and retention feature actuated.

FIGS. 62-64 show a variation where a module 78 comprises a rotating spacer mechanism similar to that of spacer 77 to also make electrical connections to the electrodes. Module 78 includes a pivoting retaining element 79 that is positioned between the electrodes and rotated 90 degrees to electrically attach the module to the electrodes. Similar to FIGS. 55-57, mechanical features in the bottom surface of the module and/or the pivoting element 79 may be used to establish and maintain the spacing between the electrodes. A separate spring member or deflection of the rotating element may be employed to cause IDC contacts 80 on the module to penetrate the insulating coating of electrodes 76 to establish a mechanical connection and compress any environmental seal in the form of a discrete gasket or insulating layers on the module and electrode. It is preferable to restrict motion of the IDC features to the perpendicular direction relative to the electrodes during the attachment process for environmental sealing.

By moving the pivoting locking member as shown instead of the module, the applied forces are directed perpendicular to the electrode during the attachment process as in the magnetic attachment embodiments discussed earlier. The insulation covering the electrode is not sliced or torn by rotation of the IDC spikes. Also like the magnetic embodiments described earlier, the insulation layer on the module does not slide against the insulation layer of the electrodes during the module attachment or removal process. This perpendicular assembly direction increases the uniformity of the sealing around the IDC spikes when attached. It also aids in self-sealing electrodes upon removal by avoiding stretching and bunching of one or more of the insulation layers caused by lateral movement of the module contacts relative to the electrodes during attachment. Ramps or other mechanical features that increase contact and sealing pressure at the IDC spikes may be incorporated into the pivoting back piece 79. By making these features smooth relative to the IDC spikes or choosing materials with low friction with the insulation layer covering the electrodes, damage to the insulation of the electrodes in contact with the pivoting back piece 79 can be avoided. When mechanical module attachment is employed as in FIGS. 58-64, the electrode strips do not need to be ferromagnetic.

Figure 65:
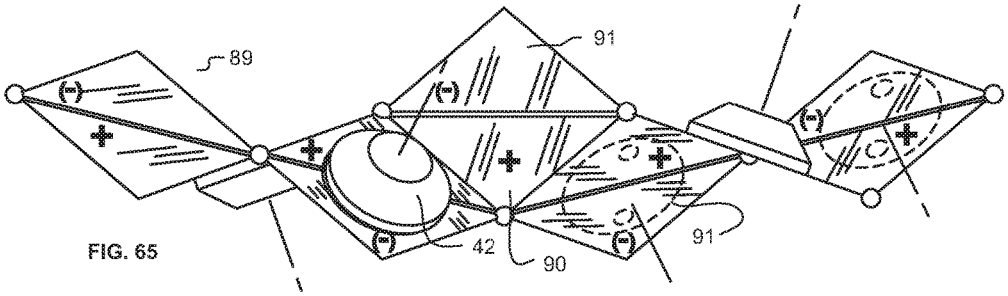
FIG. 65 is an isometric view of a folded electrode gyrating track incorporating a central folded electrode and two peripheral electrodes, with magnetic modules attached.
Figure 66:
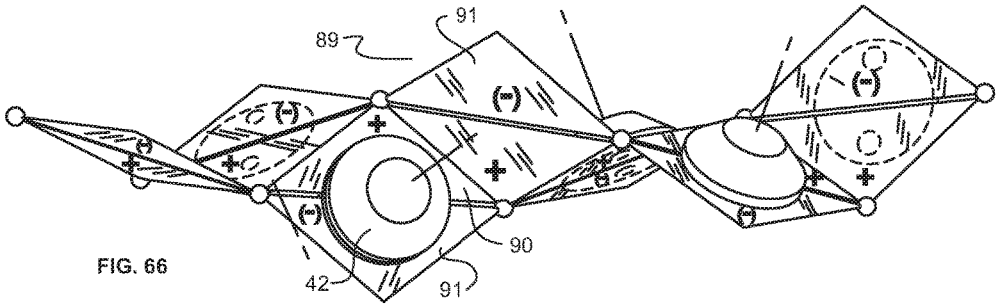
FIG. 66 is another isometric view of the folded track of FIG. 65.
Figure 67:
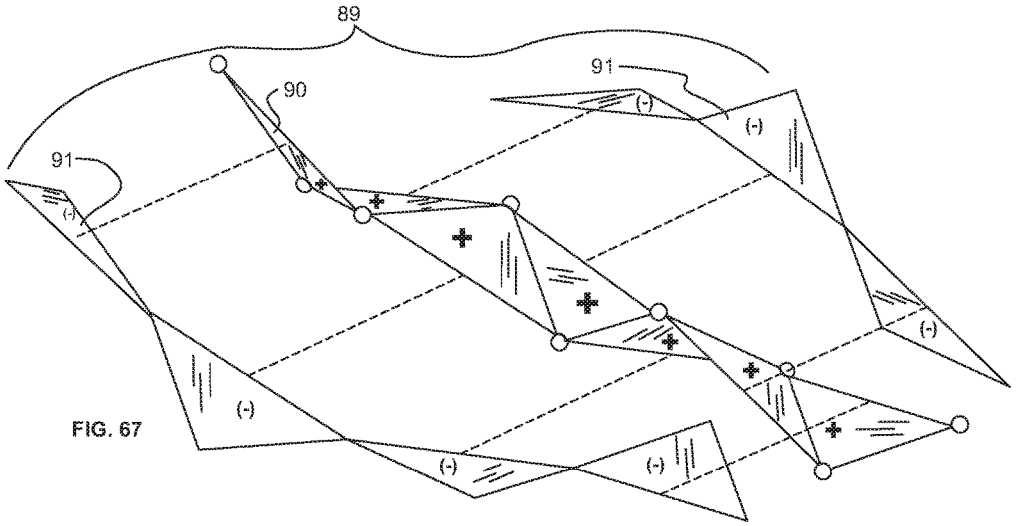
FIG. 67 is an exploded isometric view of the components of the folded track of FIG. 65 and FIG. 66.

Another form of folded electrode gyrating track is shown in FIGS. 65-67. FIG. 67 shows an exploded isometric view, FIG. 65 shows a side view analogous to FIG. 50 showing the change in axial and radial pointing directions of adjacent puck planar mounting locations. FIG. 66 is an isometric view of FIG. 65. This common center electrode track assembly 89, is comprised of a center folded electrode gyrating strip 90 and outer electrode facetted strips 91. The center electrode strip has been folded in the same manner as described above to create a folded electrode gyrating track in FIGS. 50-54. Center electrode 90 may have one electrical polarity, and outer electrodes 91 the opposite polarity. In general, in this disclosure, opposite polarities may be relative DC levels or different AC phases. Outer facetted electrodes 91 are insulated from and mechanically joined to center electrode 90, forming a planar area with two opposite polarity sections that allow electrical attachment of pucks 42 to the top or bottom of any of the flat facet areas. The outer electrode strips 91 illustrated are triangular shaped and are electrically joined at two corners and folded such that when joined to center electrode strip 90 they are locally coplanar to it. Outer electrode strips 91 may have other shapes such as semi-circular or trapezoidal sections. As before the folding of the center strip may be customized to provide different levels of module pointing gyration.

Figure 68:
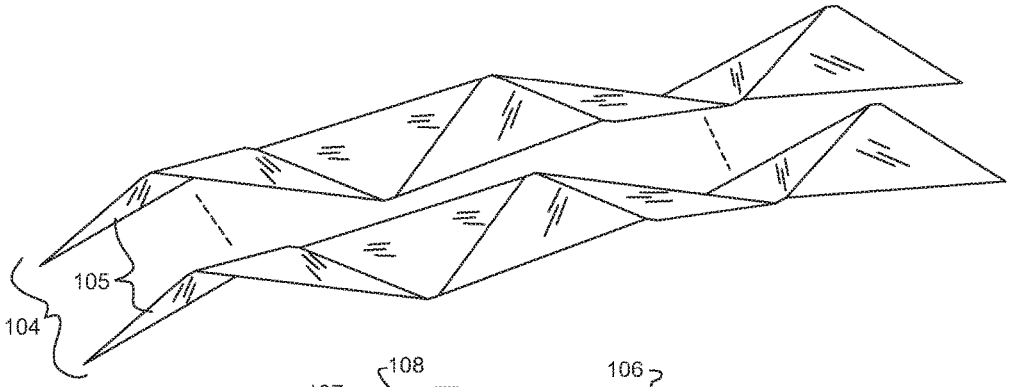
FIG. 68 is an exploded isometric view of the components of laminated parallel electrode.
Figure 69:
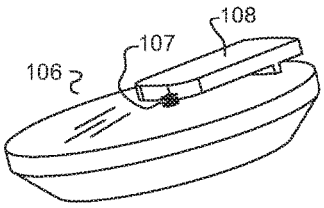
FIG. 69 is a bottom isometric view of an IDC module for use on the laminated track of FIG. 68.
Figure 70:
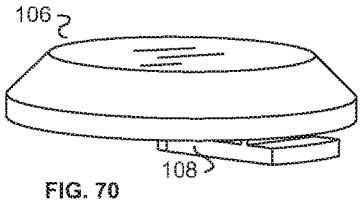
FIG. 70 is a top isometric view of FIG. 69.
Figure 71:
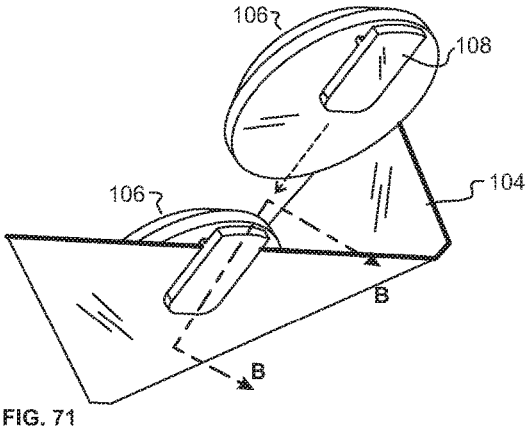
FIG. 71 is an isometric view of assembly of the IDC module and track of FIG. 68 through FIG. 70.
Figure 72:
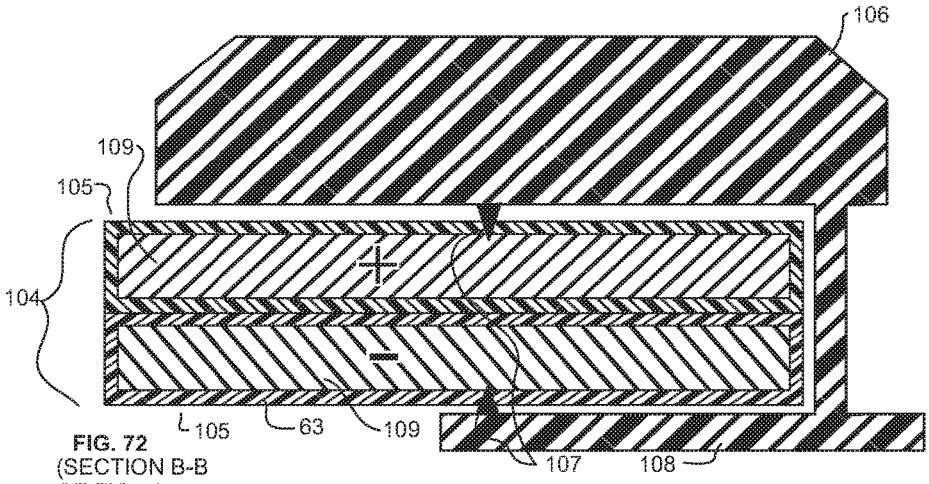
FIG. 72 is a cross-sectional schematic view of the assembled laminated track and IDC module of FIG. 68-FIG. 71.

FIG. 68-FIG. 69 illustrate a laminated track assembly 104 and electrical module 106 for electrical and mechanical attachment to track assembly 104. The electrodes in this case are located in a sandwich configuration as opposed to the lateral configuration of earlier examples. The assembled electrode track may be folded to create a gyrating monorail track assembly 104. FIG. 68 is an exploded isometric view of two insulated electrode strips 105 joined to form track 104. FIG. 69 and FIG. 70 are bottom and top isometric views, respectively, of an electrical module 106 with opposing IDC contacts 107 for mechanical and electrical attachment to track 104. FIG. 71 is an isometric view of the installation of module 106 onto track 104, and FIG. 72 is a cross-sectional schematic view of module 106 installed on track 104. Track assembly 104 may be constructed by laminating two insulated conductor strips 105 back-to-back, forming a track assembly that may be connected to an electrical supply system to provide opposite polarity electrodes on the front and back of the track assembly 104. Conductor strip electrodes 105 may be constructed from conductive metal core 109 with insulating coating 63. Strips 105 may be joined using adhesives, insulating mechanical fasteners or thermal bonding or fusing of the insulating layers. Module 106 contains opposing IDC contact spikes 107 and moveable mechanical clip arm 108 to facilitate electrical and mechanical connection. In the example of FIG. 68-72, IDC contacts 107 are located on the bottom surface of module 106 and the underside of clip arm 108. Clip arm 108 may be spring-loaded to deflect open and subsequently clamp vertically onto track 104, with IDC contacts 107 on the substrate side and clip side of module 106 penetrating insulation 63 of positive and negative electrodes 105.

Figure 73:
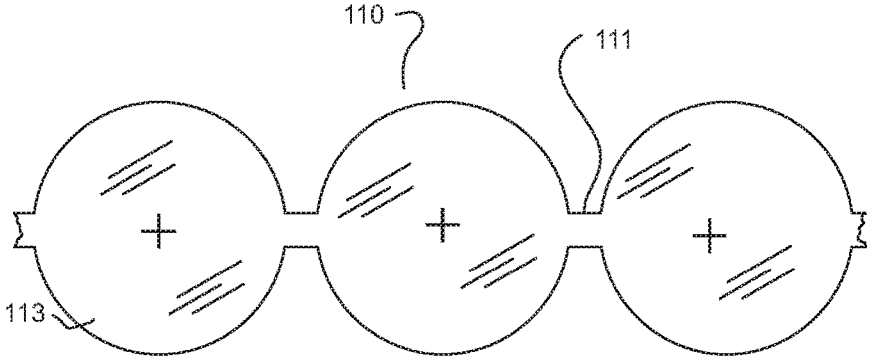
FIG. 73 is a top view of a laminated track with circular pad geometry.

Strip electrodes shapes and designs are not limited to the uniform rectangular track shapes and cross-sections shown before folding above. For example, FIG. 73 shows a top view of a disc-shaped laminated electrode assembly 110, comprised of two similar insulated electrically conductive strips 113 laminated back-to back. Necked down connecting areas 111 provide a means for easily twisting and bending the strip and individual disc portions to modify the overall shape of the track and to orient the module pointing directions of individual disks. For these laminated electrode systems, the direction of IDC spike penetration is substantially normal to the electrode surface. The thickness of the electrode insulating layer 63 or the addition of a thicker layer 105 or an additional insulating layer or gasket to the module around the IDC spikes 107 to provide environmental sealing as discussed earlier. Although mechanical mounting is preferred, module 106 could also be modified to include a source of magnetic flux for magnetic attachment to ferromagnetic versions of conducting strips 109. A complete flux loop directed perpendicular to the contact surfaces of the strips analogous to that shown in FIG. 43. In addition, the flux path could include a portion that goes through the portion of the module that abuts the edge of the electrode rail.

The laminated electrode track systems disclosed in FIGS. 68, 72 and 73 comprise two electrode strips of the same shape that are aligned in the axial direction. Electrode strips of the same shape can also be laminated with an offset in the axial direction to allow connection to both electrodes from a single side of the track.

Figure 74:
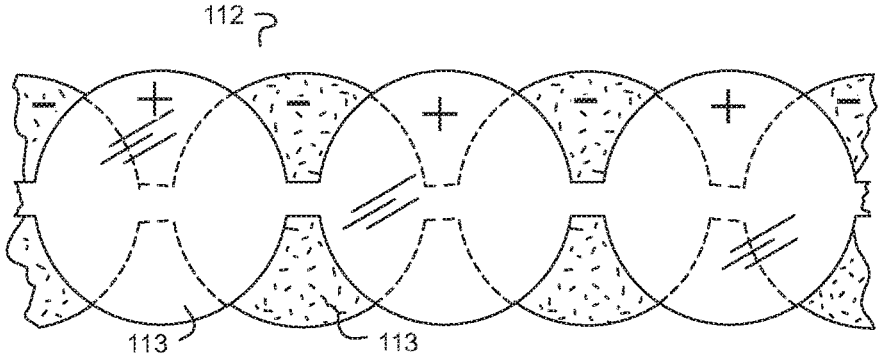
FIG. 74 is a top view of a laminated track with offset circular pad geometry.
Figure 74A:
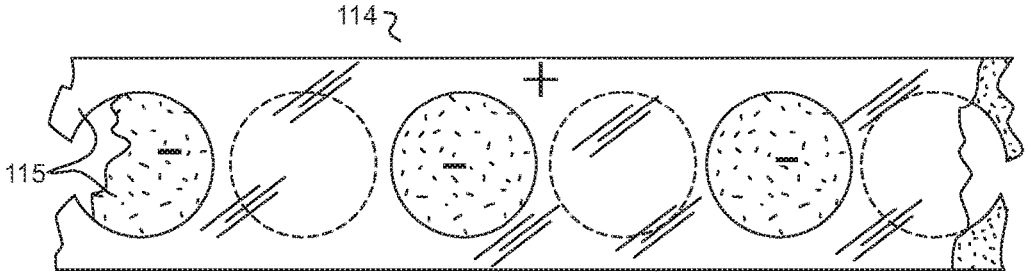
FIG. 74A is a top view of a laminated track with circular openings.

FIG. 74 shows an offset disc-shaped track assembly 117, constructed from two insulated conductor disc strips 113. In this example, an electrical module may be connected to the front and back sides of the track assembly 112, or to adjacent exposed positive and negative portions of the discs on the same side of the track assembly. This offset design may also be used for both magnetic and mechanical IDC module designs. The shapes of such two-sided and offset tracks are not limited to the discs and strips shown. For example, FIG. 74A shows an offset perforated laminated track assembly 114 comprised of two insulated perforated electrode strips 115. In this configuration, the inner surface of the second electrode is accessible through apertures in the outer surface of the first electrode, and vice versa.

Figure 75:
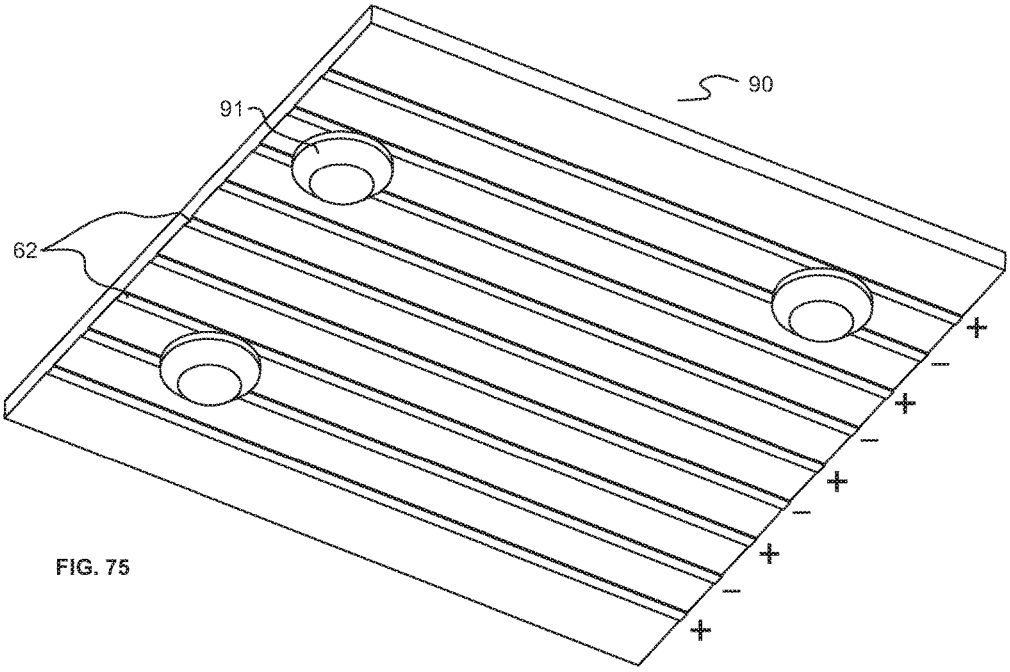
FIG. 75 is a front isometric view of a panel electrode grid.
Figure 76:
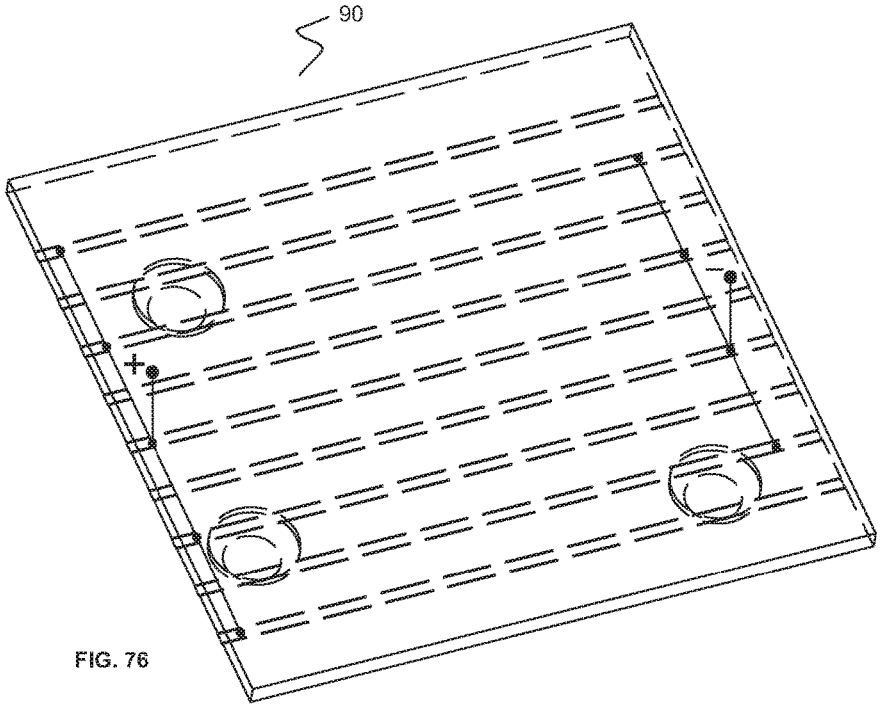
FIG. 76 is a rear isometric view of a panel electrode grid.
Figure 78:
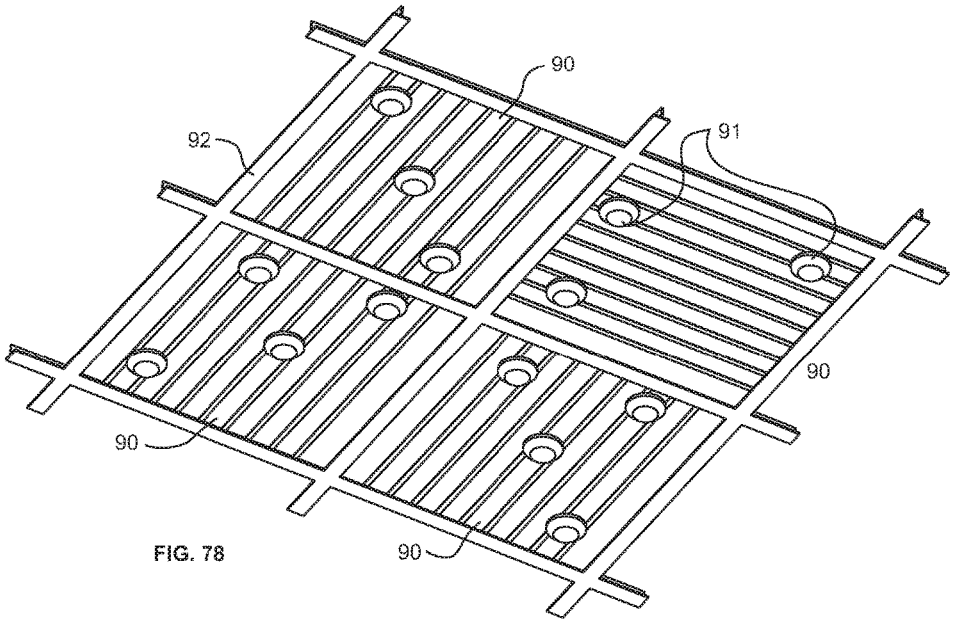
FIG. 78 is a front isometric view, of FIG. 77, of panel electrodes installed in a dropped-ceiling frame and electrically connected with multiple modules attached.

FIG. 75 and FIG. 78 illustrate an alternating electrode track panel 90 that may be used as a suspended ceiling tile or attached to a wall. FIG. 73 is a top isometric view of panel 90, and FIG. 76 is a bottom isometric view of FIG. 75. Ferromagnetic electrodes 62 may be embedded within the panel base insulating material 70 with the surface of electrodes 62 flush with the base surface, and the base and electrode assembly covered with a thin insulating layer 63, as illustrated in FIG. 39 and previously discussed. The panel base material may be a variety of insulating materials including polymers, laminated and solid wood, mineral fiber board such as used in suspended ceiling tiles. Using electrodes flush with the base surface and covering the surface with a homogeneous insulating layer 63 produces a panel where the electrodes are not visible. Alternately, insulated electrodes may be disposed on the surface of a panel or embedded in a thermally conductive base as discussed previously.

In preferred embodiments, the electrode panels are constructed to be compatible for use in building materials and modular furniture. For example, the electrode panel of FIG. 75 and FIG. 76 may be constructed to be compatible with standard dropped-ceiling square and rectangular tile. The panel of FIG. 75 and FIG. 76 include a series of alternating polarity electrodes, such that an electrical device incorporating IDC contacts may be magnetically attached and electrically connected at any position between any two adjacent electrodes. These are shown as parallel electrodes extending from one side to the other of the panel. Other paths of electrodes could be employed. If the electrodes and modules utilize alternating current, there is no polarity orientation needed when attaching a module. FIG. 76 shows a back side isometric view schematically illustrating alternating electrodes connected to the plus and minus side of an alternating current power source. The module and electrodes are shown as dotted lines since they are located on the opposite side. Modules 91 may be attached at any position on the panel surface illustrated. Alternate configurations may provide isolated attachment locations if desired. The modules may have varied functions such as lighting, cameras, sensors, charging, Wi-Fi transceivers, and other communication antennae. Electrodes are not constrained to linear shapes, and may be virtually any geometric shape and cross-section including, for example serpentine shapes, and round, "L" or "I" shaped cross-sections.

Figure 77:
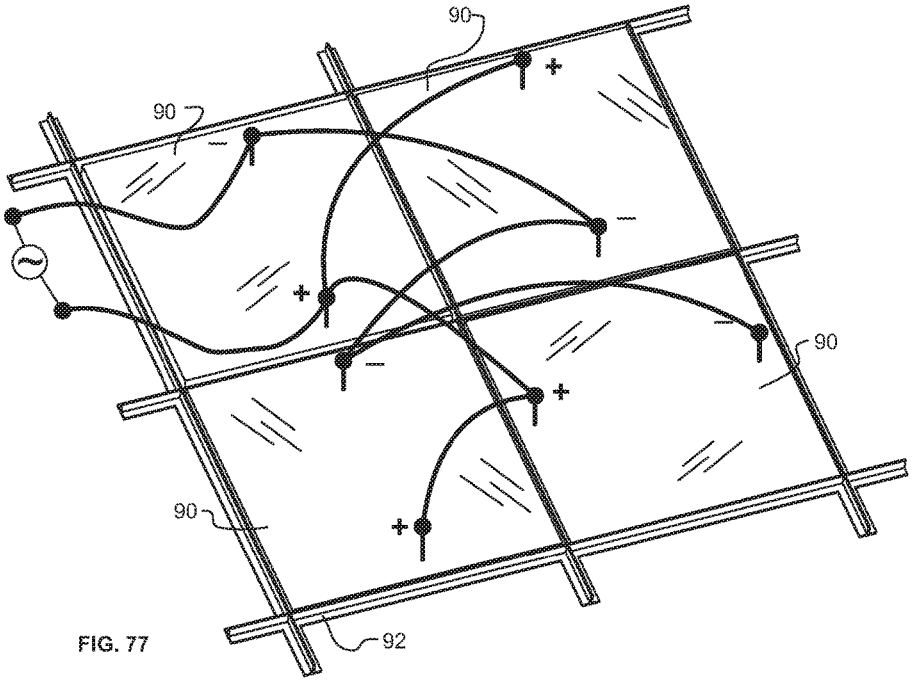
FIG. 77 is a rear isometric view of panel electrodes installed in a dropped-ceiling frame and electrically connected.

FIG. 77 and FIG. 78 illustrates four electrode panels 91 of FIG. 75 and FIG. 76 installed into a dropped-ceiling grid 92. FIG. 77 shows alternating polarity electrode connections connected in parallel on the rear side of the grid assembly, and attached to a common power source. FIG. 78 shows a top isometric view of the four electrode panels with a number of modules 91 connected to the grid in varied locations.

Figure 79:
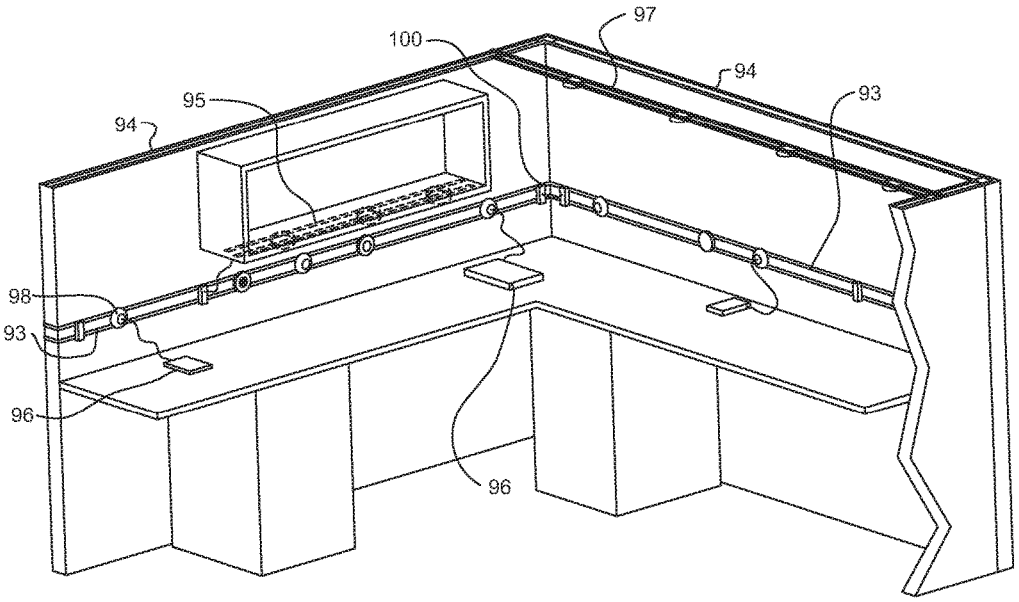
FIG. 79 is an isometric view of modular furniture showing various types of track and rail applications.

Electrode track and grid systems may also be incorporated into residential and commercial furniture, particularly modular furniture. Such systems provide variable and flexible positioning of lighting, charging and other functions, and also reduce cable clutter. FIG. 79 is shows an embodiment of electrode track systems used in a modular furniture application. A horizontal wall track 93 is shown, with (e.g. 5-volt DC USB) charging modules 98 connected to electronic devices 96. Also illustrated are under-cabinet tracks 95, and top wall electrode tracks 94 with suspended lighting tracks 97 attached. Track components may be constructed to allow electrical connection during the assembly process, such as with edge connectors between wall panels, or may be connected using various magnetic or mechanical interconnection components such as wires, plates or magnetic jumpers. FIG. 79 illustrates a magnetic jumper component 100 that magnetically attaches to the two orthogonal track portions and interconnects them with jumper conductors.

Figure 80:
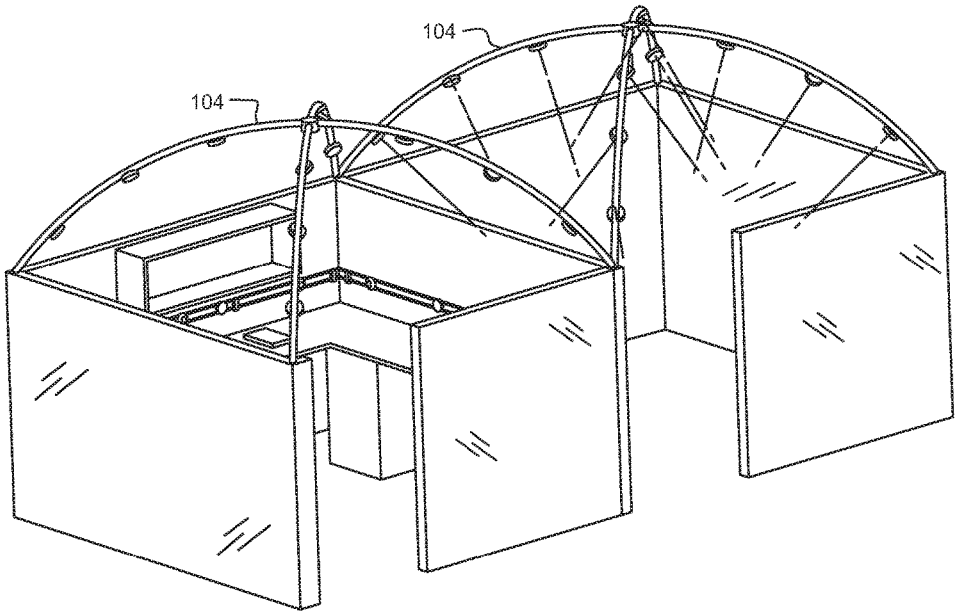
FIG. 80 is an isometric view of an office cubicle with arched overhead track system installed.

FIG. 80 illustrates an arched electrode track system 104 for providing flexible lighting for modular furniture such as cubicles. Lighting modules and other electrical devices may be attached at any position along the arched tracks, and the tracks and/or modules further adjusted by rotation about the nominal axis of the arch. The electrode track system may be constructed using any of the flat and folded electrode track systems described in this specification or using track systems disclosed in previously cited U.S. Pat. No. 8,651,711 and co-owned U.S. Pat. No. 9,303,854 hereby incorporated by reference. This embodiment may provide energy-savings and more flexible ergonomic lighting customization options within cubicles compared to typical random placement of cubicle walls under fixed placement existing ceiling lighting in a building.

Figure 81:
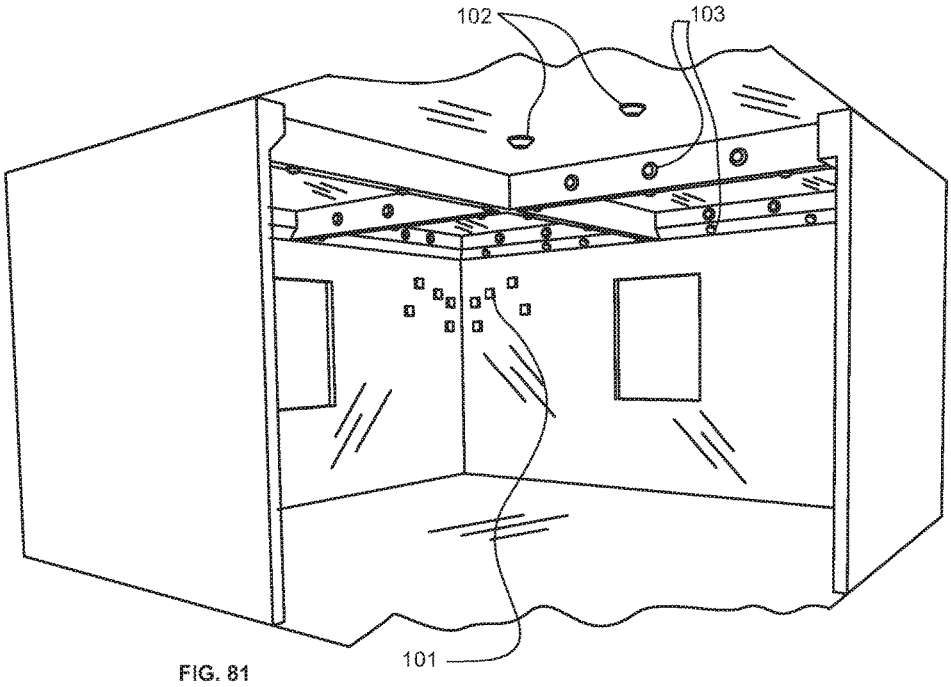
FIG. 81 is an isometric view of a room showing electrode systems incorporated into building materials and architectural features.

FIG. 81 illustrates examples of track and grid systems incorporated into construction and building materials. For example, visible or invisible track and grid systems may be incorporated into building materials such a sheetrock, molding and trim materials, paneling material, to provide electrical connectivity to modules. FIG. 81 illustrates modules attached to a vertical wall 101 and ceiling attached modules 102 (as may be accomplished with grid systems embedded in sheetrock or paneling), modules attached to molding components 103 (as may be accomplished with grid systems embedded in trim components).

Embodiments above include mechanical and magnetic elements to provide attachment forces that may be classified as passive since no additional source of energy is required to maintain the forces after attachment. Passive mechanical forces may result from devices including springs, wedges, levers, bolts, screws or other non-magnetic gripping or clamping elements. Passive magnetic forces result from permanent magnets and materials that are attracted to magnets including other magnets or ferromagnetic materials. Active devices that require power for maintaining and/or creating mechanical forces may also be substituted for passive devices including pneumatic and hydraulic pistons or bladders, electromagnetic solenoids and electromagnets while incorporating inventive concepts disclosed.

Several embodiments of the invention have been described. It should be understood that the concepts described in connection with one embodiment may be combined with the concepts described in connection with another embodiment (or other embodiments) of the invention.

While an effort has been made to describe some alternatives to the preferred embodiment, other alternatives will readily come to mind to those skilled in the art. Therefore, it should be understood that the invention may be embodied in other specific forms without departing from the spirit or central characteristics thereof. The present examples and embodiments, therefore, are to be considered in all respects as illustrative and not restrictive, and the invention is not intended to be limited to the details given herein.

Some embodiments above describe electrically insulated electrodes in which insulation displacement is used to penetrate the electrical insulation to make an electrical connection between a module and the electrodes. Some embodiments include magnetic forces to make electrical and mechanical attachments. Some embodiments include environmental sealing features on one or more elements of an electrical connection. Some embodiments employ rotating elements to establish and maintain mechanical attachments to electrodes and some also make electrical attachment to electrodes. Some embodiments include thermal transfer between modules and fixtures. These descriptions and schematic drawings of embodiments are presented to illustrate inventive concepts and are not exhaustive. Different combinations of features than those illustrated or described for a particular embodiment are considered to be within the scope of this disclosure.

What is claimed is:

1. A system for electrical attachment of a module to an electrode system comprising:

an electrode system comprising:

a first electrode having a first electrode contact surface;

wherein the first electrode comprises a ferromagnetic material;

a module comprising:

a housing;

an electrical interface;

wherein the electrical interface comprises:

an electrical contact spike;

wherein at least a portion of the electrical contact spike is capable of movement relative to the housing;

a magnetic structure;

wherein the magnetic structure comprises:

a permanent magnet;

one or more ferromagnetic pole pieces;

wherein the magnetic structure is operable to provide a magnetic attractive force between the electrical interface and the first electrode that is directed substantially perpendicular to the first electrode contact surface;

wherein the magnetic attractive force is characterized by a magnetic flux circuit including the permanent magnet, the one or more ferromagnetic pole pieces and the first electrode;

wherein the magnetic flux is substantially perpendicular to the first electrode contact surface at the electrical contact spike;

an electrically insulating layer; and wherein the electrically insulating layer is positioned to be compressed around the electrical contact spike by the magnetic attractive force when the electrical contact spike is electrically attached to the electrode contact surface.

2. A system for electrical connection between a module and an electrode system comprising:

a module;

wherein the module comprises:

an insulation displacement spike;

a first electrode;

wherein the first electrode comprises:

a first electrode contact surface;

an electrically insulating layer;

wherein the electrically insulating layer is configured to be penetrated and deformed by the insulation displacement spike through a compressive force applied in a direction substantially perpendicular to the first electrode contact surface thereby providing environmental sealing of the insulation displacement spike;

wherein the first electrode has a first linear segment;

a second electrode;

wherein the second electrode has a second linear segment;

a spacer;

wherein the spacer is configured to maintain the first linear segment substantially parallel to the second linear segment; and wherein the spacer is configured for attachment to the first electrode through a rotation about an axis perpendicular to the first linear segment.

3. An insulation displacement connection system for electrical attachment of a module to an electrode system comprising:

a first electrode comprising:

a first electrical attachment surface;

a first electrically insulating layer;

wherein the first electrically insulating layer is positioned over the first electrical attachment surface;

a second electrode;

wherein the electrode system has a shape characterized by a plurality of folds;

wherein the plurality of folds comprises:

a plurality of positive fold line angles;

a plurality of negative fold line angles;

a plurality of positive surface fold angles;

a plurality of negative surface fold angles;

a module comprising:

an electrical interface surface comprising:

a first electrical contact;

wherein the first electrical contact comprises:

an insulation displacement spike;

an electrical circuit;

wherein the electrical circuit is adapted to transfer at least one of electrical energy and electrical data through the first electrical contact; and wherein the insulation displacement spike is configured to extend through the first electrically insulating layer when the module is attached to the first electrical attachment surface.

4. The system for electrical attachment of a module to an electrode system of claim 1 wherein the electrically insulating layer comprises at least one electrically insulating film;

wherein the at least one electrically insulating film is configured to provide environmental sealing of at least one of the electrical contact spike and the first electrode contact surface prior to the electrical attachment of the module to the electrode system; and wherein the at least one electrically insulating film is configured to be pierced by the electrical contact spike during the electrical attachment of the module to the electrode system.

5. The system for electrical attachment of a module to an electrode system of claim 1 wherein the electrically insulating layer comprises an electrically insulating coating on the first electrode contact surface.

6. The system for electrical attachment of a module to an electrode system of claim 1 comprising an IDC plate wherein the electrical contact spike is formed on the IDC plate.

7. The system for electrical attachment of a module to an electrode system of claim 1 wherein the electrode system has a longitudinal axis and wherein the first electrode comprises:

a first strip electrode comprising:

a first front face;

a first rear face;

a plurality of first edges;

wherein the first front face and the first rear face define a first thickness therebetween;

wherein the first front face is oriented perpendicular to the longitudinal axis and has a lateral extent determined by the plurality of first edges;

wherein the electrode system further comprises:

a second strip electrode comprising:

a second front face;

a second rear face;

a plurality of second edges;

wherein the second front face and the second rear face define a second thickness therebetween;

wherein the second front face is oriented perpendicular to the longitudinal axis and has a lateral extent determined by the plurality of second edges; and wherein the first front face and the second front face are essentially parallel where the module is attached to the electrode system.

8. The system for electrical attachment of a module to an electrode system of claim 7 wherein the first strip electrode has a first edge segment that is not parallel to the longitudinal axis.

9. The system for electrical attachment of a module to an electrode system of claim 7 wherein the first strip electrode and the second strip electrode are oriented back-to-back;

wherein at least a portion of the second front face comprises:

an obscured area;

an exposed area;

wherein the obscured area is separated from the exposed area along a boundary; and wherein the boundary comprises a segment of one or more first edges.

10. The system for electrical attachment of a module to an electrode system of claim 9 wherein the first strip electrode and the second strip electrode are shaped and positioned to expose portions of the following:

the first front face;

the second front face;

the first rear face; and the second rear face.

11. The system for electrical attachment of a module to an electrode system of claim 9 wherein the orientation of the first front face is modified by twisting about the longitudinal axis.

12. The system for electrical attachment of a module to an electrode system of claim 9 wherein the boundary includes a segment that is not parallel to the longitudinal axis.

13. The system for electrical attachment of a module to an electrode system of claim 7 wherein the first strip electrode and the second strip electrode comprise a planar array and wherein the planar array is incorporated into a building panel, architectural element or furniture element comprising electrically insulating material.

14. The system for electrical attachment of a module to an electrode system of claim 2 further comprising a module insulating layer wherein the module insulating layer is penetrated by the insulation displacement spike when the module is attached to the electrode system.

15. The system for electrical attachment of a module to an electrode system of claim 2 wherein the spacer is incorporated into the module and wherein the module is electrically connected to the first electrode contact surface through rotation of at least a portion of the module about an axis that is not substantially parallel to the first linear segment.

16. The system for electrical attachment of a module to an electrode system of claim 2 wherein the spacer is attached to a mounting surface prior to the rotation of the spacer that attaches the first electrode to the spacer.

17. The system for electrical attachment of a module to an electrode system of claim 2 wherein the spacer further comprises locking structures operable to obstruct a reverse rotation after the spacer is attached to the first electrode.

18. The insulation displacement connection system for electrical attachment of a module to an electrode system of claim 3 wherein the electrical interface surface further comprises:

a second electrical contact; and wherein the second electrical contact is located laterally of the first electrical contact.

19. The insulation displacement connection system for electrical attachment of a module to an electrode system of claim 3 wherein the module has a mechanical clamping element configured to provide a mechanical biasing force on the insulation displacement spike after the module is electrically attached to the electrode system.

20. The insulation displacement connection system for electrical attachment of a module to an electrode system of claim 19 further comprising an opening between the first electrode and the second electrode; and wherein the mechanical clamping element includes a portion that is designed to be inserted in the opening and rotated during the electrical attachment of the module to the electrode system.

21. The insulation displacement connection system for electrical attachment of a module to an electrode system of claim 3 wherein the surface fold angles have a magnitude of 130 to 145 degrees and the fold line angles have a magnitude of 30 to 45 degrees.

* * * * *